US010082279B2

(12) United States Patent
Jones et al.

(10) Patent No.: US 10,082,279 B2
(45) Date of Patent: Sep. 25, 2018

(54) LIGHTING SYSTEM FOR SUSPENDED CEILING

(71) Applicants: Jonathan I. Jones, Highland, NY (US); Frank Cogliano, Pomona, NY (US); Eran Moses, Woodridge, NY (US)

(72) Inventors: Jonathan I. Jones, Highland, NY (US); Frank Cogliano, Pomona, NY (US); Eran Moses, Woodridge, NY (US)

(73) Assignee: USAI, LLC, New Windson, NY (US)

( * ) Notice: Subject to any disclaimer, the term of this patent is extended or adjusted under 35 U.S.C. 154(b) by 1 day.

(21) Appl. No.: 15/494,174

(22) Filed: Apr. 21, 2017

(65) Prior Publication Data

US 2017/0336058 A1 Nov. 23, 2017

Related U.S. Application Data

(60) Provisional application No. 62/325,822, filed on Apr. 21, 2016.

(51) Int. Cl.

| | |
|---|---|
| ***F21S 8/00*** | (2006.01) |
| ***F21V 21/04*** | (2006.01) |
| ***E04B 9/00*** | (2006.01) |
| *F21S 8/02* | (2006.01) |
| *F21S 8/06* | (2006.01) |
| *F21V 29/76* | (2015.01) |
| *E04B 9/14* | (2006.01) |
| *F21S 9/02* | (2006.01) |
| *F21V 29/74* | (2015.01) |

(52) U.S. Cl.

CPC ..... *F21V 21/044* (2013.01); *E04B 9/006* (2013.01); *F21V 21/048* (2013.01); *E04B 9/14* (2013.01); *F21S 8/026* (2013.01); *F21S 8/06* (2013.01); *F21S 9/02* (2013.01); *F21V 29/74* (2015.01); *F21V 29/763* (2015.01)

(58) Field of Classification Search

CPC ..... F21V 21/048; F21V 21/04–21/046; F21V 23/003; F21V 23/007–23/008; F21S 8/0226

USPC ..... 362/148

See application file for complete search history.

(56) References Cited

U.S. PATENT DOCUMENTS

| | | | | |
|---|---|---|---|---|
| 3,816,880 A * | 6/1974 | Jacobs | E04B 9/006 | 362/150 |
| 5,699,641 A * | 12/1997 | Tinen | E04B 9/006 | 248/343 |
| 6,345,800 B1 * | 2/2002 | Herst | E04B 9/006 | 248/342 |
| 6,722,918 B2 * | 4/2004 | McCoy | H01R 13/60 | 439/110 |
| 2015/0159824 A1 * | 6/2015 | Colan | F21S 8/043 | 362/191 |

* cited by examiner

*Primary Examiner* — Sean Gramling
(74) *Attorney, Agent, or Firm* — St. Onge Steward Johnston & Reens LLC

(57) ABSTRACT

A lighting fixture for a suspended ceiling including a grid of rails and hub forming an opening in the suspended ceiling has a housing with a mounting clip operable to toollessly mount to a vertical portion of a rail from above with a cam to resiliently expand the mounting clip laterally during mounting of the housing onto the rail, a light unit support connected to the housing and operable to toollessly mount to the hub, from above, and a light unit operable to toollessly mount to the light unit support, through the hub, from below the suspended ceiling.

20 Claims, 23 Drawing Sheets

LIGHTING SYSTEM FOR SUSPENDED CEILING

FIELD OF THE INVENTION

The present invention is directed to the field of lighting fixtures, and in particular to lighting systems for suspended ceilings.

BACKGROUND

A suspended ceiling (also known as a drop ceiling) is a common ceiling style. A suspended ceiling has two basic parts: lightweight ceiling panels and a suspended framework composed of a grid of rails for supporting the ceiling panels. The grid is attached to the existing ceiling or other structure with hangers or wires, and then the panels are inserted inside the grid. Typically, each rails has an inverted-T cross section with opposed, laterally extending, horizontal flanges for supporting the ceiling tiles and a vertical portion extending upwardly from the horizontal flanges, Traditionally, lighting, such as relatively small "down lights," have been incorporated into suspended ceilings by mounting the lighting fixtures within the ceiling tiles. However, this method requires cutting a hole in the ceiling tiles. Also, with this method, the ceiling tile supports the lighting fixture and over time the ceiling tile can deform or sag under the weight of the lighting fixture. Furthermore, the lighting fixture inhibits movement or replacement of the tile as may be desired.

Therefore, what is desired is an improved method of incorporating lighting in to a suspended ceiling.

SUMMARY OF THE INVENTION

The lighting system of the present invention provides an improved method and system for incorporating lighting in a suspended ceiling.

The lighting system is suitable for a suspended ceiling having, for example, a framework including a grid of rails having opposed, laterally extending, horizontal flanges for supporting the ceiling tiles and a vertical portion extending upwardly from the horizontal flanges. The framework also includes a hub interconnecting a number of rails, which forms an opening in the suspended ceiling for receiving a light fixture.

The lighting system has a lighting fixture with a light unit and a housing for enclosing a lighting driver for the light unit. The housing is operable to toollesly mount to the vertical portion of a rail connected to the hub, from above the rail, and has a mounting clip operable to engage opposing sides of the vertical portion of the rail. The mounting clip is operable to resiliently expand laterally during mounting of the housing onto the rail and includes a cam surface operable to engage the rail to resiliently expand the mounting clip during mounting onto the rail. When the housing is mounted to the rail, the housing allows mounting and removal of ceiling tiles to the rail and the rail remains operable to support ceiling tiles on both lateral sides of the rail, below the housing.

The vertical portion of the rail includes a relatively wide head and a relatively narrow web below the head and the mounting clip has a locking portion adapted to be disposed below and to engage a bottom of the head of the rail, when the housing is mounted on the rail. The housing has a bias operable to bias the housing upwardly from the rail and to urge the locking portion against the bottom portion of the head of the rail.

The lighting fixture has a light unit support which can be rigidly connected to the housing. The light unit support is toollessly mountable to the hub, from above. The hub has a vertical peripheral wall defining the opening in the suspended ceiling and the light unit support has a vertical peripheral wall adapted to closely surround the peripheral wall of the hub and to contact top portions of at least two opposed sides of the peripheral wall of the hub.

Opposing sides of the peripheral wall of the hub each have a slot and opposing sides of the peripheral wall of the light unit support have a resilient retainer clip operable to toollessly and removably engage an associated slot of the hub. Each retainer clip has a first cam operable to engage a top of the peripheral wall of the hub and to resiliently deflect the retainer clip outwardly from the peripheral wall of the hub, during mounting of the light unit support to the hub. Each retainer clip can also have a second cam operable to engage an edge of an associated slot of the peripheral wall of the hub and to resiliently deflect the retainer clip outwardly from the peripheral wall of the hub, during removal of the light unit support from the hub.

The light unit is removably and toollessly mountable to the light unit support, through the hub, from below the suspended ceiling. The light unit has one or more mounting slots on at least two opposed sides thereof. The light unit support has corresponding number of pin(s) projecting inwardly from the peripheral wall thereof on at least two opposing sides, the pin(s) being operable to engage an associated mounting slot of the light unit, to mount the light unit to the light unit support.

The pin(s) on each side are jointly resiliently mounted to the light unit support and biased in an engaged position wherein the pin(s) are engaged with an associated pair of mounting slots, and the pin(s) are movable to a disengaged position wherein the pin(s) are disengaged from the associated pair of mounting slots.

One of the pin(s), for example a lower pin, has a cam surface operable to contact a side of the light unit and to deflect the pin(s) outwardly from the light unit during mounting of the light unit to the light unit support. And, the pin(s) are operable to prevent upward and/or downward removal of the light unit from the light unit support in the engaged position and to permit at least downward removal of the light unit from the light unit support in the disengaged position.

The light unit has lens and has a lens retaining frame disposed around a periphery of the lens, and the lens retaining frame being spring biased against the lens on opposed sides of the lens retaining frame.

Other objects of the invention and its particular features and advantages will become more apparent from consideration of the following drawings and accompanying detailed description.

DETAILED DESCRIPTION OF THE INVENTION

Figure 1:
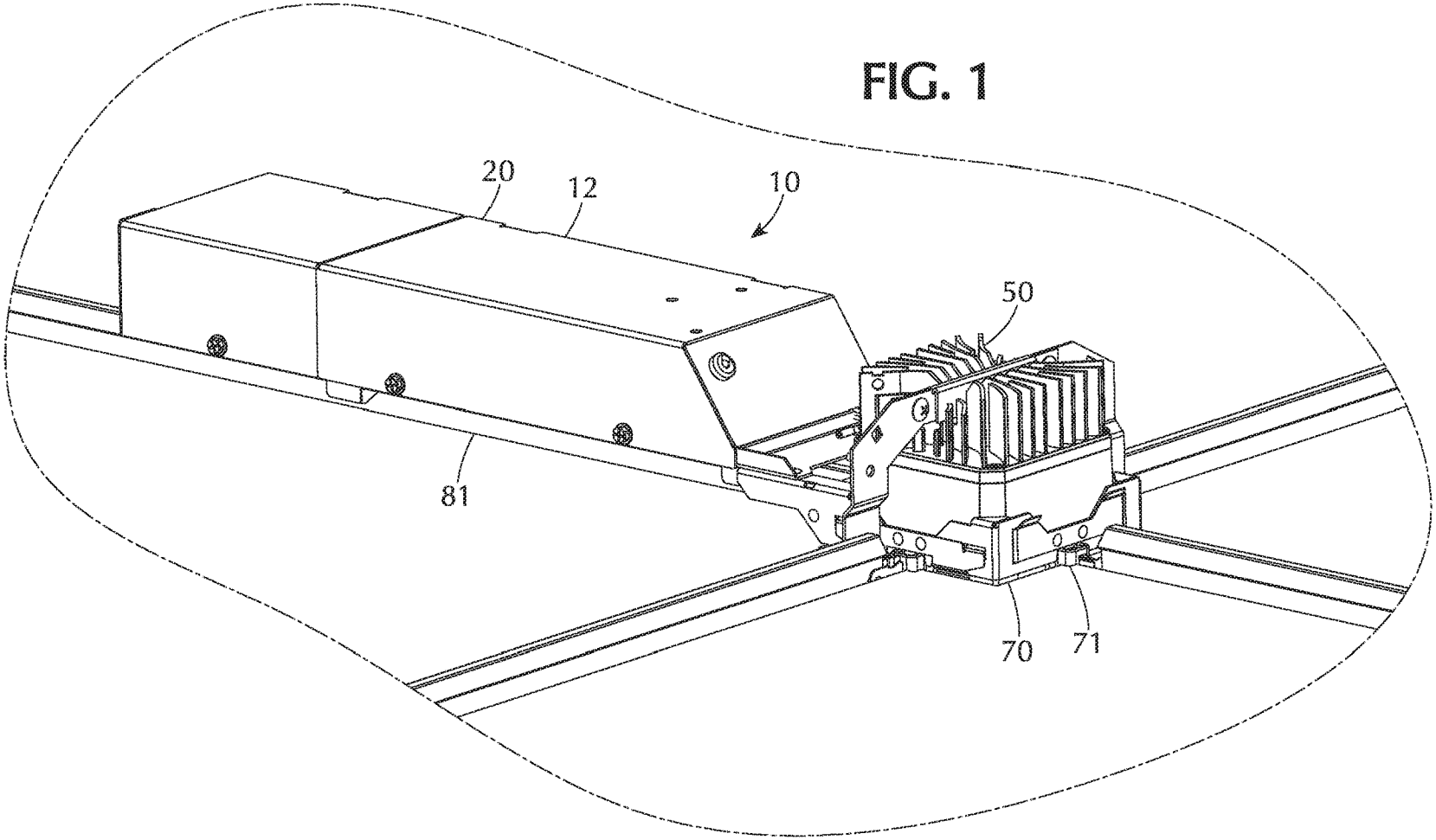
FIG. 1 is a perspective view of the lighting system mounted to a drop ceiling support frame in accordance with an embodiment of the present invention.

Referring to FIGS. 1-23, a lighting system (10) for suspended ceilings is disclosed. A suspended ceiling or drop ceiling is a ceiling that is suspended below the structural ceiling of a room. Drop ceilings typically consist of light weight ceiling tiles or panels supported by a horizontal framework formed by a grid of intersecting rails. The framework typically includes a first set of parallel, regularly spaced rails interconnected and intersected by a second set of perpendicular, regularly spaced rails, thereby forming an open grid of cells for supporting the ceiling tiles. The rails are often shaped as inverted Ts. As described in this specification the rails can have a cross-section comprising a vertical upper portion with a bulging section at the top called the head or bulb and a narrower midsection known as the web connected to the head via a step portion, and a horizontal lower portion having a pair of opposed flanges extending horizontally laterally from near a bottom of the vertical portion. However, the lighting system may be installed on drop ceiling support frames formed with any other types of channels.

The support frame or grid is attached to the ceiling and suspended therefrom with hanger wires or hanger rods. The hanger wires or rods can attach to the support frame at the junction points of the grid, or at other locations such as midpoints of the rails. The ceiling tiles or panels are disposed in the cells of the grid or support frame as defined by the rails and are supported by the flanges of the rails or T-bars.

The framework includes hubs (70) at certain rail intersections for supporting light fixtures at the intersections. The hub (70) is a generally horizontal frame that serves both as a support for a light fixture and an interconnect for intersecting rails. The hub (70) has a vertical peripheral wall encircling and defining an opening in the suspended ceiling. The hub can have a generally square, rectangular, or circular frame, or another shape, in a plan view (i.e., as vied from above). The hub (70) is generally co-planar with the drop ceiling, and is positioned at the center of an intersection of rails. Each of the rails (81) forming the intersection therefore terminates at the hub (70) and connects to a side of it. Accordingly, each side of the hub (70) is provided with a means of connecting to a rail (81). In the embodiment shown, the square hub (70) features a vertical slit in the midpoint of each of its four sides for engaging the corresponding hook terminating each of the four connecting rails (81). Each side of the hub (70) can include a protrusion (71) at the midpoint of the side which contains the vertical slit for connecting the rail.

The hub (70) includes a peripheral horizontal flange similar to the flange of the rails to support adjacent ceiling tiles and to conceal any space or gap between the finished ceiling tile and the hub in order to provide an attractive appearance for the light fixture. The flange can surround the outer perimeter of hub, at or close to its bottom edge. The flange features a further protrusion (73) outward at the midpoint of each side where the rail connects to the hub (70). The protrusion has the same or similar width as the foot of the rail (81) or the base of the T-bar (81), so that when the rail is connected to the hub (70), both devices blend seamlessly and appear to be integrally formed as seen from the bottom.

The lighting system of the present invention is designed for mounting on the rails (81) and hub (70) that form the drop ceiling framework, such that its light unit is placed at the junction of the rails (81), as shown in FIGS. 1 & 4-6. Thus, as seen from below, the point where the rails of a drop ceiling normally cross is replaced by a recessed light fixture, located in the opening in the suspended ceiling formed by the hub. Accordingly, to accommodate the lighting system, hubs (70) can be installed at various locations, at a point of intersection of the rails (81), to provide various locations for lighting.

The lighting system (10) of the present invention includes a light fixture (12) having a housing (20) with an enclosure for a driver and a junction box, a light unit support, such as collar (40), a light unit (50), and mounting hardware. The housing (20) is adapted to for toolless mounting on a single rail (81) of the drop ceiling's support framework, from above the framework. The light unit support/collar (40) is adapted for toolless mounting to the hub (70), from above the framework. The light unit (50) is adapted for toolless mounting to the collar (70), from below the suspended ceiling. Components of the lighting system (10) will be further described below.

Figure 18:
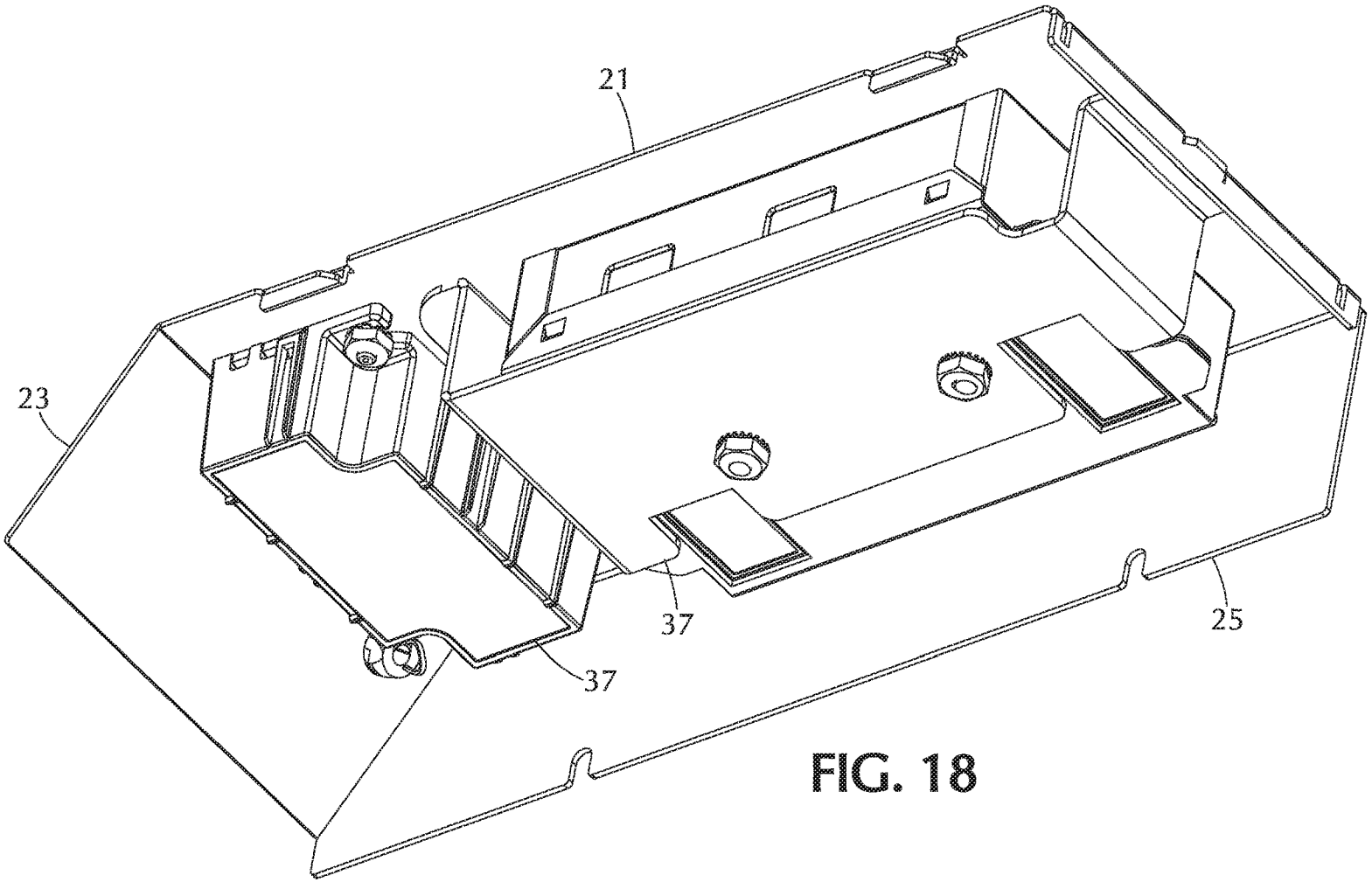
FIG. 18 is a perspective view of a cover of the light fixture housing showing a driver and other components in accordance with an embodiment of the present invention.
Figure 19:
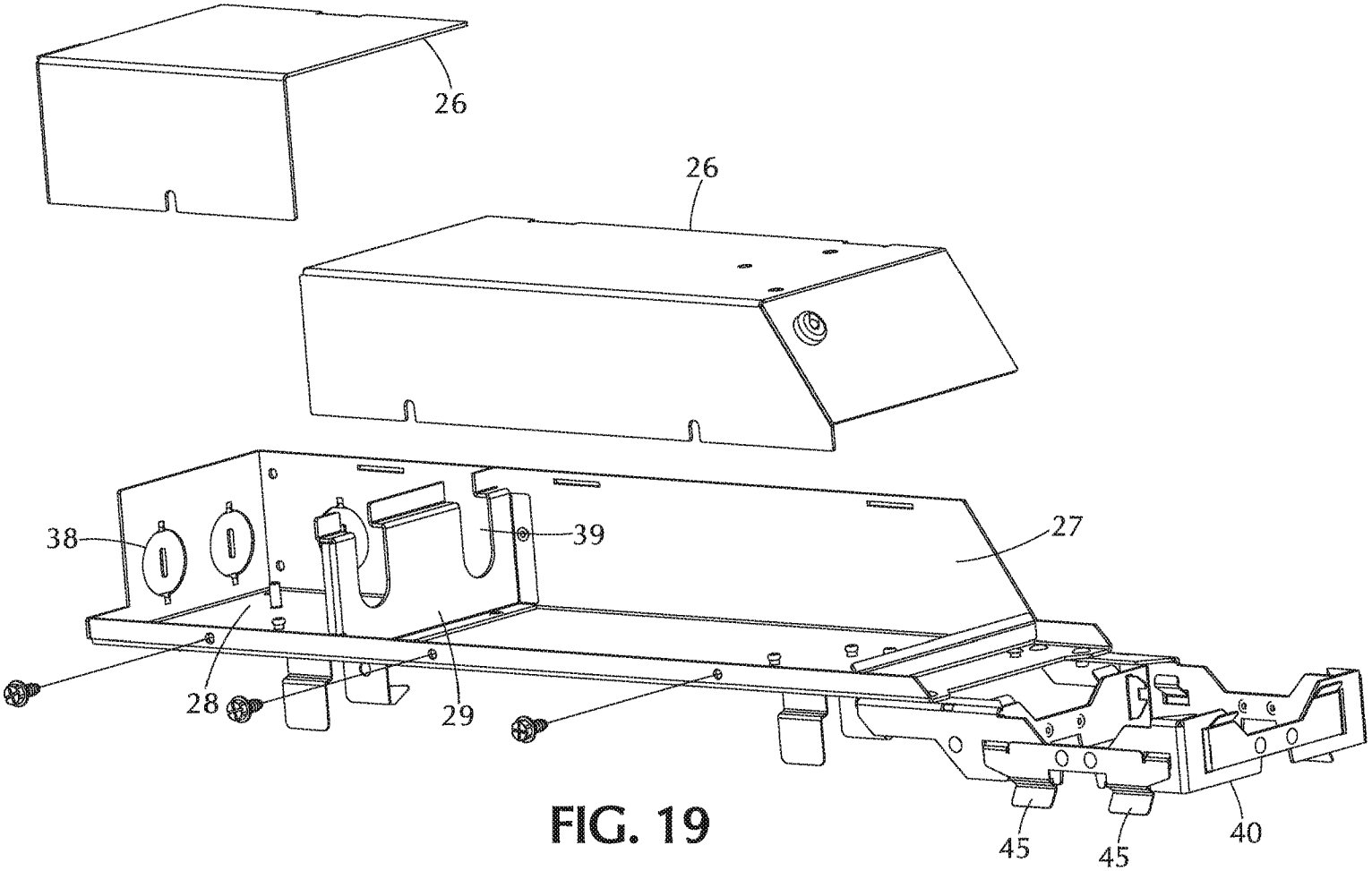
FIG. 19 is an exploded view of the light fixture housing in accordance with an embodiment of the present invention.

The housing (20) of the lighting system (10) can be an elongated box-like enclosure that generally constitutes the majority of the length of the lighting fixture as shown. The enclosure has six generally orthogonal walls, which are the top (21), bottom (22), front (23), back (24), and two side walls (25). In the embodiment shown, the housing (20) has a horizontally elongated shape in the front to back direction. As illustrated in FIG. 19, one or more walls of the housing is removable to provide access to the interior of the housing. The removable wall(s) serve therefore as cover (26) for the housing. In some embodiments, such as shown in FIG. 18, the housing cover (26) is formed of three adjacent walls, such as the top wall (21), a side wall (25), and the front wall (23). The housing (20) is typically formed of a rigid material metal such as sheet metal or similar.

The housing (20) is partitioned into a front and rear compartment (27, 28) by a vertical divider or partition (29) (see FIG. 19). The partition or divider (29) is provided with holes (39) through which electrical wiring connects the front and rear compartments (27, 28). The rear compartment (28) serves as a junction box. The junction box (28) serves to receive wiring for powering the lighting system. Knockout holes (38) are provided on the walls of the rear compartment (28) and external wiring runs through these holes to terminals and connectors inside the compartment (28).

The front compartment (27) of the housing encloses several electronic components (37) and electrical interconnects required for powering the light unit. These include for example an LED driver, ballast, and like devices. The electrical components (37) may be mounted directly to the walls of the enclosure. In some cases, the components (37) are mounted to a plate mounted to the wall of the enclosures. In some embodiments, the electrical components (37) are mounted on the removable cover (26) of the housing (see FIG. 18).

Figure 20:
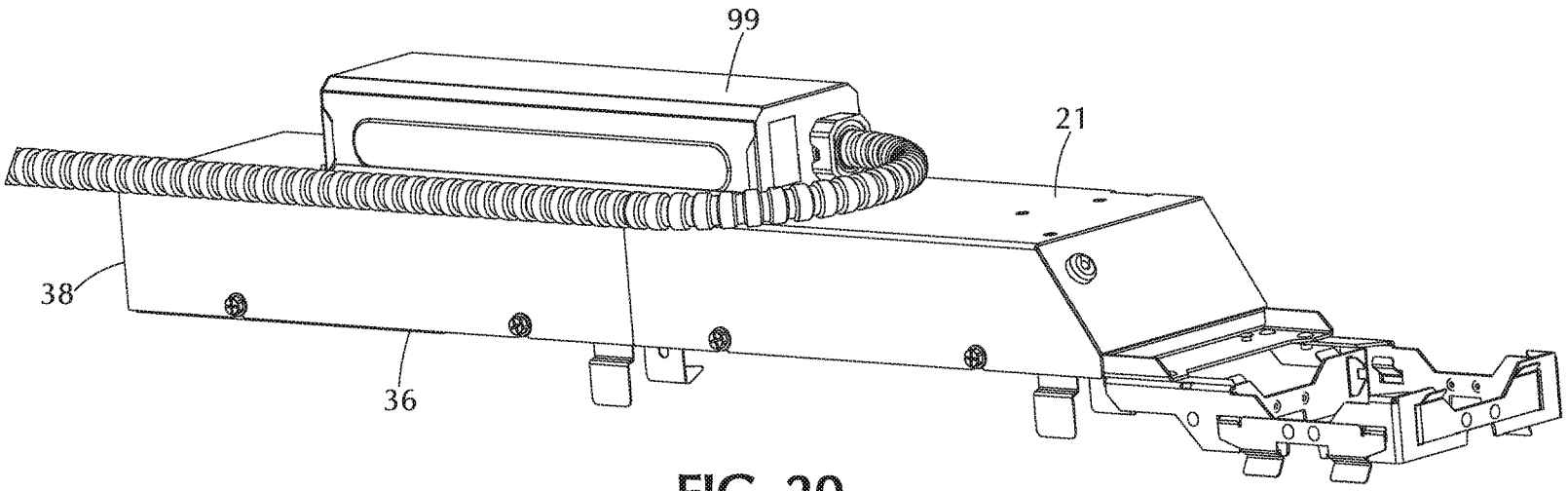
FIG. 20 a perspective view of the light fixture with a battery pack installed on the housing in accordance with an embodiment of the present invention.
Figure 21:
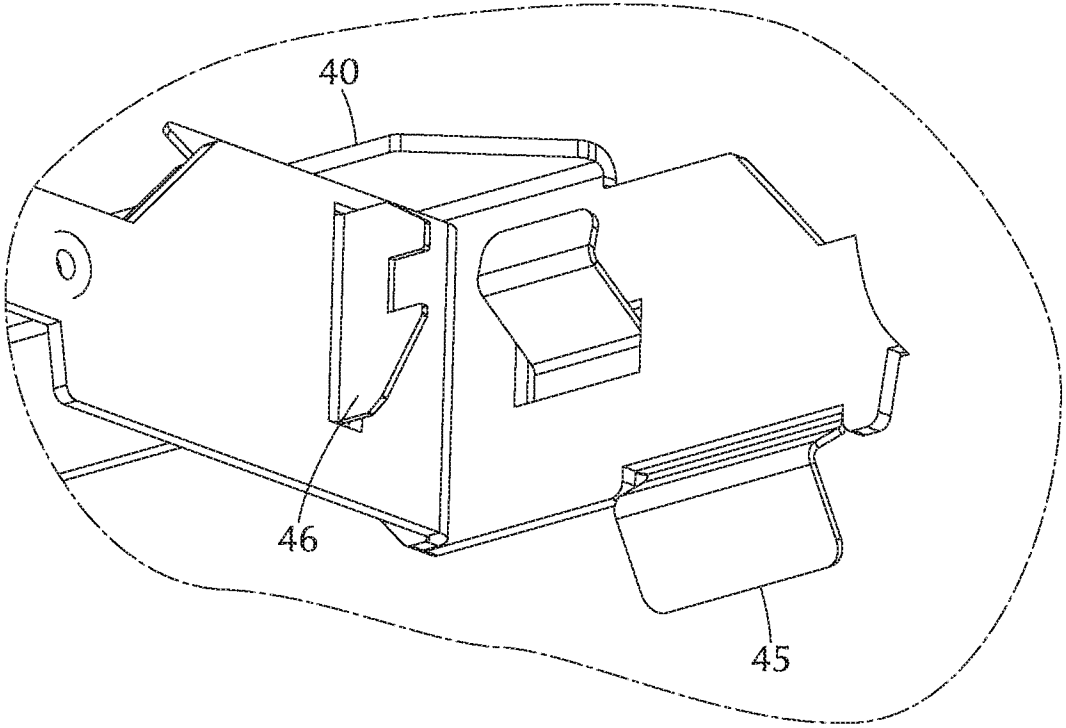
FIG. 21 is a view of the collar showing a retainer clip for mounting the collar to the hub and a pair of mounting pins for mounting a light unit to the collar.

The housing (20) can accommodate a number of modifications. For example, the housing can be extended with an extension box (36), as shown in FIG. 20. The housing extension (36) is typically added to the back wall (24) of the housing. The extension box (36) has the same profile as the housing, such that when the extension box is mounted, the top, side, and bottom walls of the extensions are aligned with the same sides of the housing (20) and the extension (36) and housing appear to be integrally formed. The extension box may have its own removable cover (26). Knockout holes (38) on the back of the housing allow wiring between the rear compartment (28) of the housing and the extension box (36). Knockout holes (38) may be provided on the housing extension as well.

The housing (20) may also accommodate an external battery backup pack (99), shown in FIG. 20. Typically, the battery backup (99) is an elongated pack fastened to the top wall (21) of the housing. Depending on the length of the battery pack (99), the housing (20) may be extended as described above to accommodate longer packs.

Figure 2:
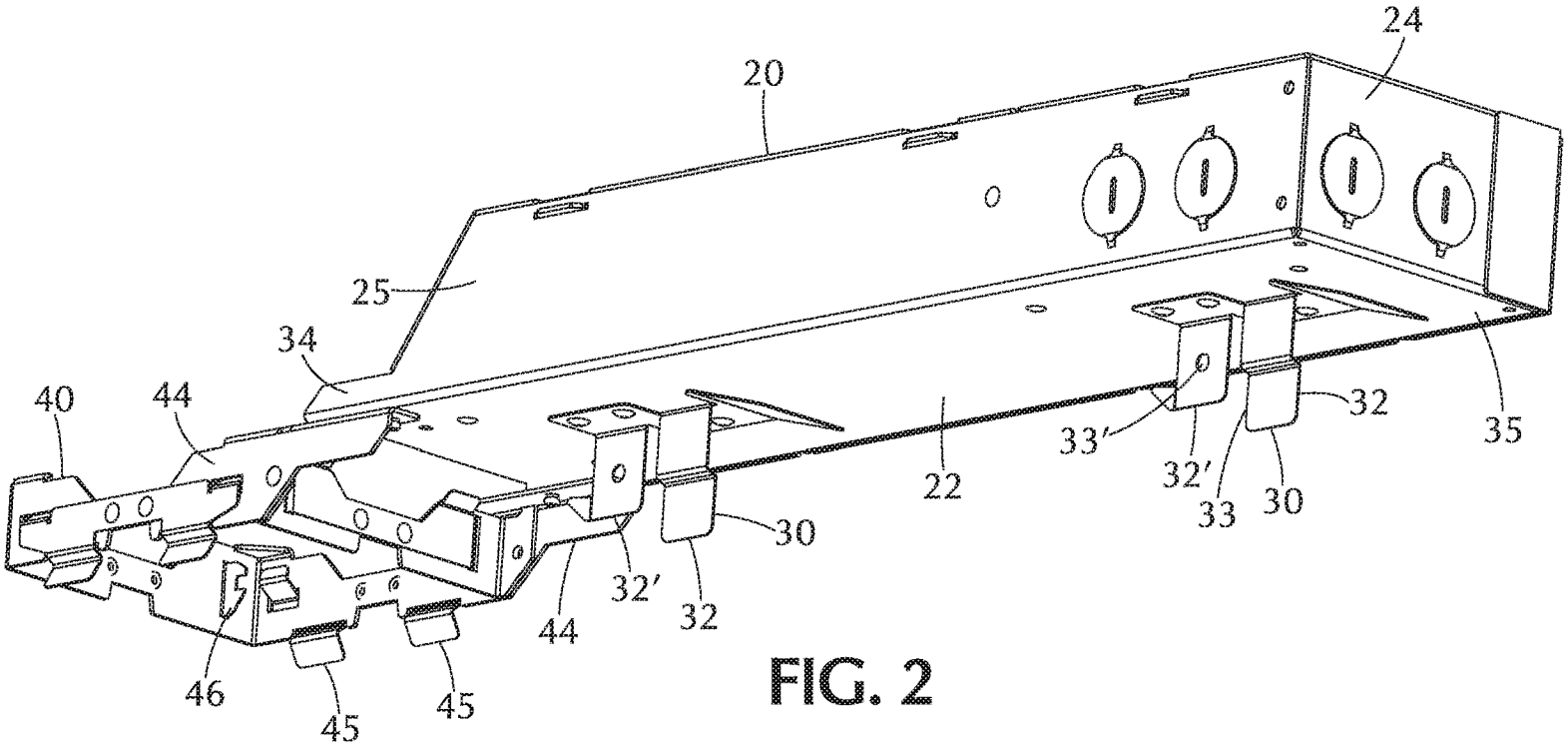
FIGS. 2 & 3 are perspective views of the lighting system with the light fixture dismounted in accordance with an embodiment of the present invention.
Figure 22:
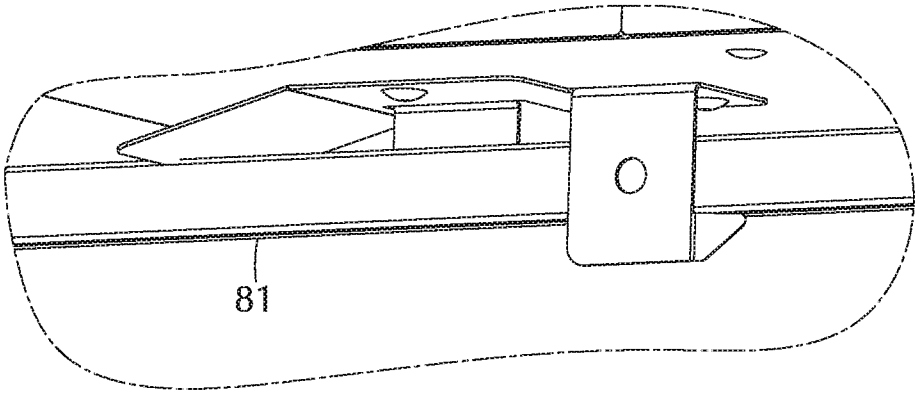
FIG. 22 is a view of a clip connected to a rail showing the second tab and resilient spring tab.
Figure 23:
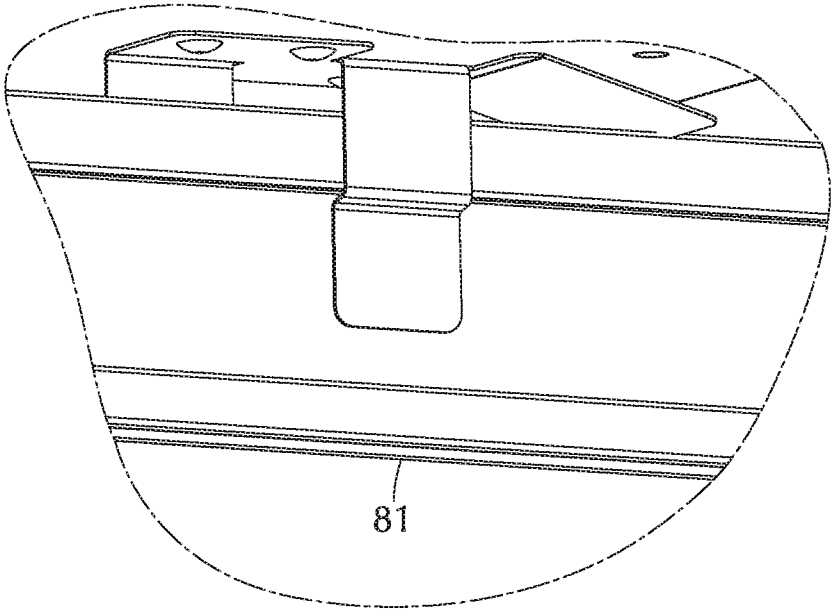
FIG. 23 is a view of a clip connected to a rail showing the first tab and resilient spring tab.

The housing is mounted to a single rail (81) without the use of tools with mounting clips (30) provided at the bottom of the housing, as best shown in FIGS. 2 & 22-23. Preferably, at least two mounting clips are provided. The clips are disposed and aligned along a longitudinal central axis or centerline of the bottom of the housing, in alignment with the rail on which they mount. The clips are made of a strong but flexible and spring-like material, such as metal. Each clip (30) can have a base (31) formed of metal mounted to the bottom wall of the light fixture housing, and a pair of spaced apart, resilient tabs (32, 32') that extend generally vertically and downward from the base (31) near, and on either side of, the centerline of the bottom wall (22) of the housing. On each clip, the pair of tabs sandwiches the vertical plane that includes the centerline of the housing and the rail (81) supporting the housing. An upper portion of each tab is adapted to closely abut the head of the rail, while a lower portion of each tab is adapted to closely receive and abut the step and/or web portion of the rail. A lower section of each tab (32, 32') angles inward to provide a hook against the step (and/or a bottom of the head) of the rail onto which they clamp. Thus, when the clip (30) is mounted to the rail (81), the head of the rail fits in the space between the upper portions of the pair of tabs, whereas the narrower lower portions of the pair of tabs (32, 32') clamp onto the narrower web of the rail.

On each clip (30), a first tab (32) can have a vertical upper portion and an inwardly-spaced vertical lower portion joined to the upper portion by a horizontal step such that the first tab has an inside profile generally corresponding to the profile of a side of the rail (or at least a portion of such profile). The step of the first tab (32) is adapted to extend under and engage the step of the rail, between the head and web of the rail. A second tab (32') of each clip can have a vertical upper portion laterally spaced from the upper portion of the first tab a distance corresponding to a lateral thickness of the head of the rail. The second tab also has a lower portion with a generally triangular flange extending horizontally laterally inwardly from a side vertical side edge thereof. The flange has a horizontal upper edge which is adapted to extend under and engage the step of the rail. The flange has a bottom edge which is angled upwardly and laterally inwardly to provide a cam surface to assist in mounting the light fixture to the rail such that during mounting, the cam surface causes the resilient tabs (32, 32') to deflect laterally outwardly to receive the head of the rail and then to return to engage the step of the rail. Thus, the clips allow the housing to be toollessly mounted to the rail by having the clips aligned with the rail and pushing the housing against the rail until the resilient tabs (32, 32') securely engage the rail as described above.

Although the clips are designed for toollessly mounting the fixture to the rails, optional mounting holes (33') are provided in one or both tabs of each clip for fastening the clip to the rail. One or more holes (33') for screws and other fasteners may thus be located on the upper, lower, or both portions of the first tab (32), as well as on the second tab (32').

Each clip (30) can also include an integral resilient spring tab (35) disposed between the housing (20) and rail to bias the housing of the light fixture upward from the rail such that the tabs securely engage the step of the rail. The spring tab (35) also serves to ensure that the clip can accommodate diverse dimensions for the heads or bulbs of various rails or T-bars. In particular, the biasing action of the spring tab (35) allows clip (30) to securely grip rails having heads substantially shorter than the upper portions of the tabs (32, 32'). This allows the housing fixture (10) to be used with a variety of suspended ceilings. The spring tab (35) can be in the form of a flange extending longitudinally downwardly from the base of the clip at an angle and can have a free end portion which contacts a top of the rail, or can be another resilient bias.

The tabs (32, 32') of each clip (30) are longitudinally offset from each other in the direction of the rail such that the tabs do not face each other but instead a longitudinal space (33) exists between them. This improves the balance of the housing on the rail and enables a more secure grip. This offset between the tabs also prevents each tab from interfering with the fastener(s) of the other tab in cases where the clips are further secured to the rails with fasteners as described above.

When the housing (20) is mounted to the rail, the housing can mounting clips still allow ceiling tiles to be installed in the suspended ceiling and supported by the rail below the housing. The housing, when mounted, extends over such ceiling tiles on either side of the rail and the mounting clips are essentially flush with the vertical portion of the rail, and thus the rail is still operable to support ceiling tiles under the housing and lighting fixture.

It should be noted that the housing (20) can be mounted to any type of support frame that forms a suspended ceiling. Although this disclosure describes mounting clips adapted for a framework of rails, other types of mounting clips adapted for different types of support frames may be used.

The lighting system (10) further includes a light unit support or collar (40). The collar (40) is located at the front of the housing preferably at or below the plane of the bottom (22) of the housing, and serves to both mount the light fixture to the hub of the drop ceiling framework and as a support structure for the light unit of the light fixture. (see FIGS. 1-3). In some embodiments, the collar (40) is rigidly connected to the front of the housing. The connecting member between the collar (40) and the housing (20) includes portions (34) of the bottom wall (22) of housing, which extend past its front wall (23) to join with the collar (40). In other embodiments, the collar is connected to the housing with a flexible conduit. This provides the flexibility to separate the housing from the collar. For example, the housing may be mounted further away on a rail that does not connect with the hub.

The collar (40) is a generally horizontal frame shaped and sized as the horizontal cross section of the light unit (50) it is designed to hold and/or that of the hub. Thus the collar may be of rectangular, square, circular or other shape, and preferably closely matches the shape of the light unit (50) and/or hub. In the embodiment shown, the collar is square-shaped. The collar can have a contiguous vertical peripheral wall with four vertical walls—a front (41), a back (42), and two side walls (43)—arranged to define a square space or opening to receive the light unit, however other contiguous or non-contiguous configurations of the collar are also suitable, including a collar having less than four sides (for example, two sides).

Figure 3:
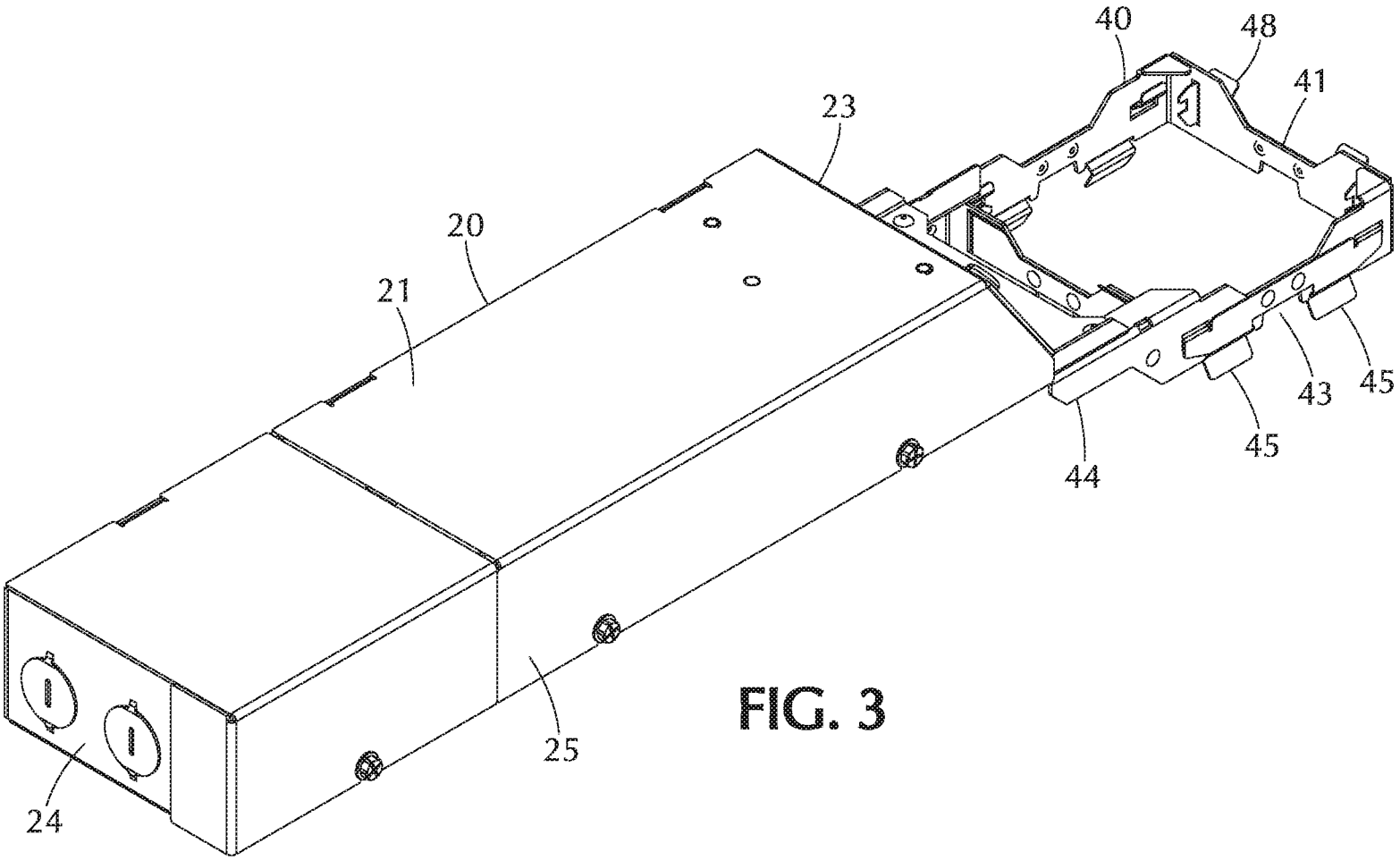
Figure 4:
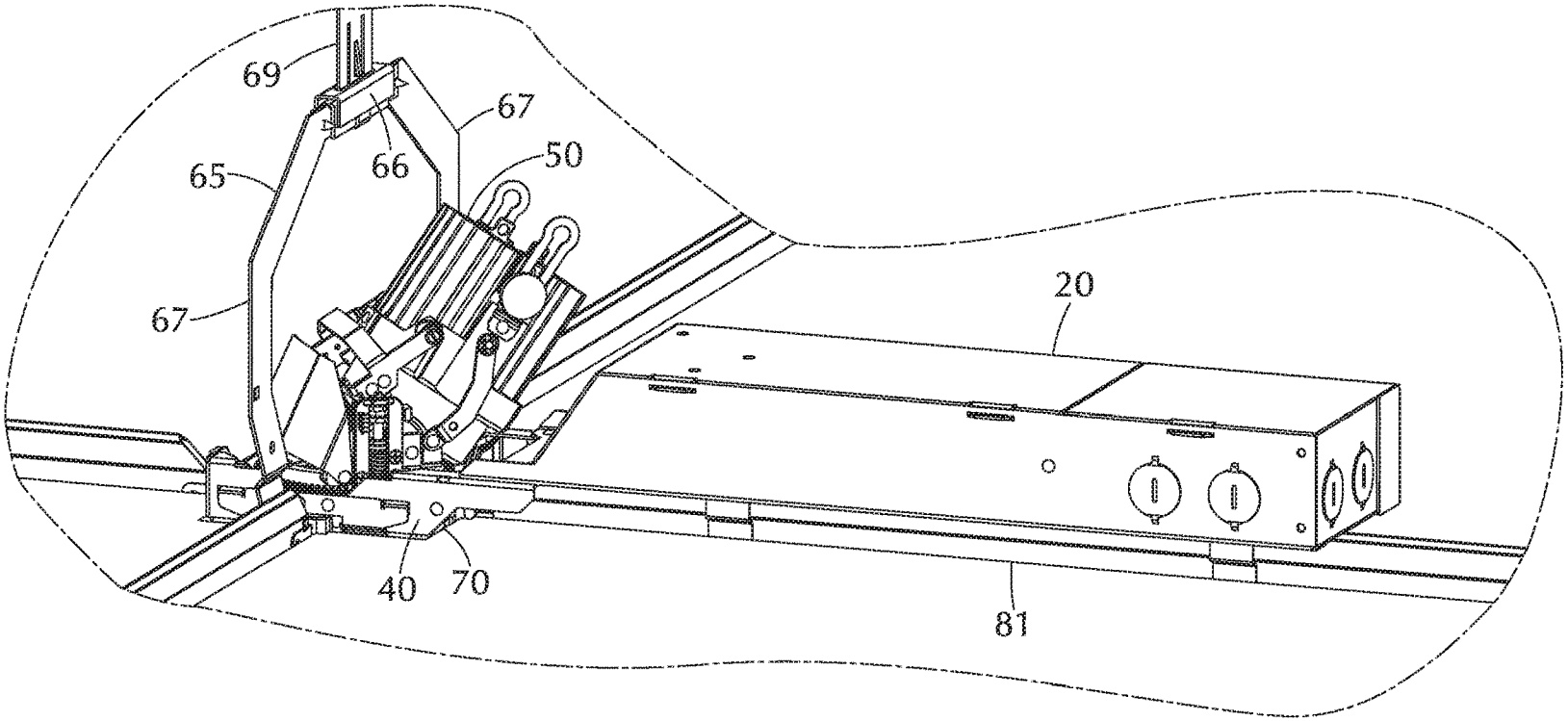
FIG. 4 is a perspective view of the lighting system with the light fixture mounted to a drop ceiling support frame featuring a yoke and having a tilting light unit in accordance with an embodiment of the present invention.
Figure 5:
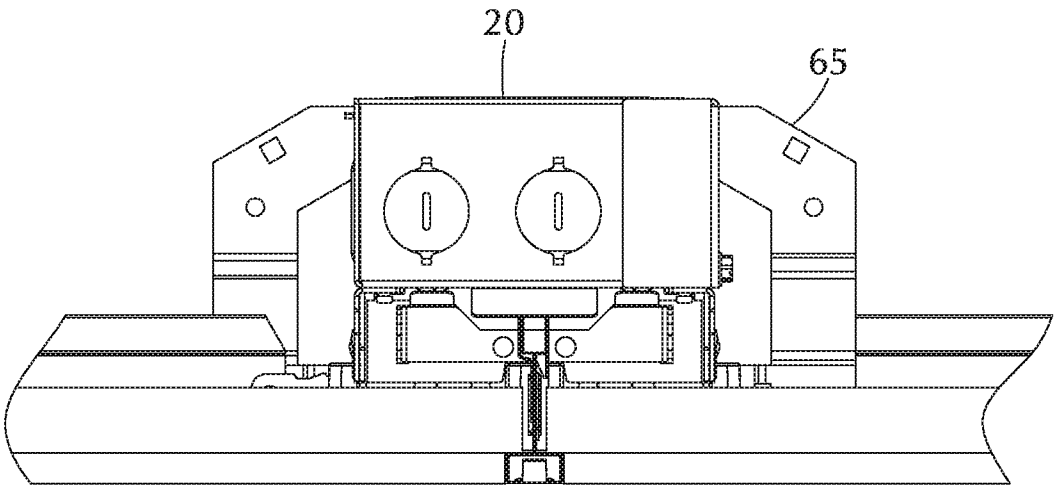
FIG. 5 is a rear view of the lighting system with the light fixture mounted to a drop ceiling support frame featuring a yoke in accordance with an embodiment of the present invention.
Figure 6:
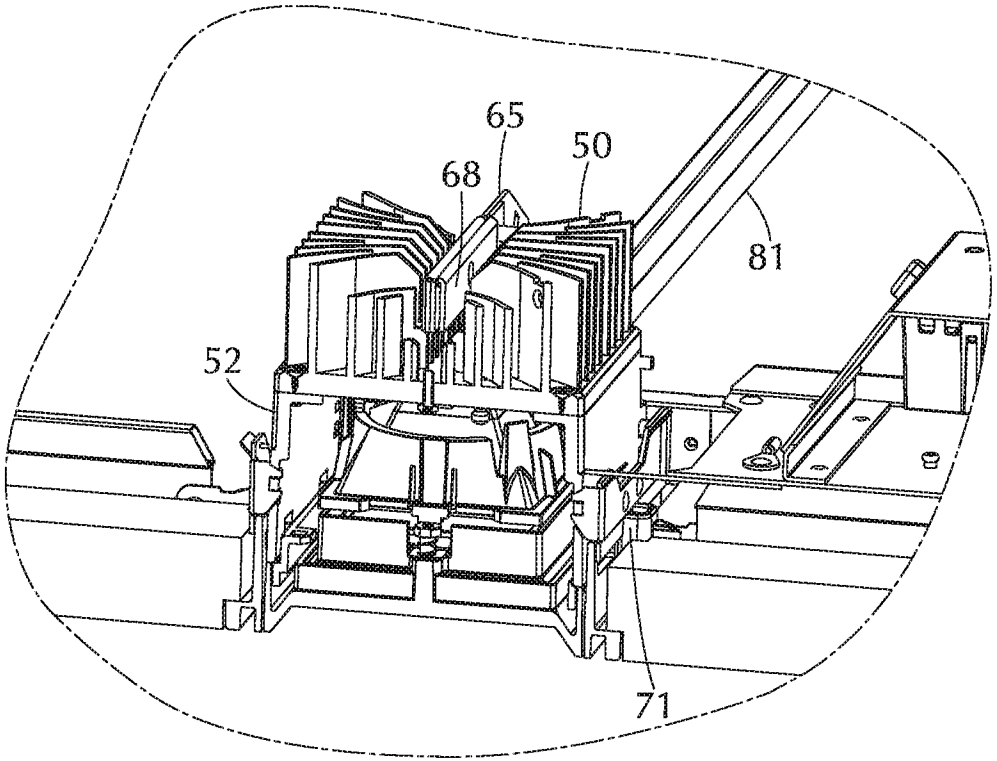
FIG. 6 is a cross-section view of the lighting system showing a light unit mounted to the light fixture and showing the lighting elements, the heatsink and the yoke in accordance with an embodiment of the present invention.
Figure 7:
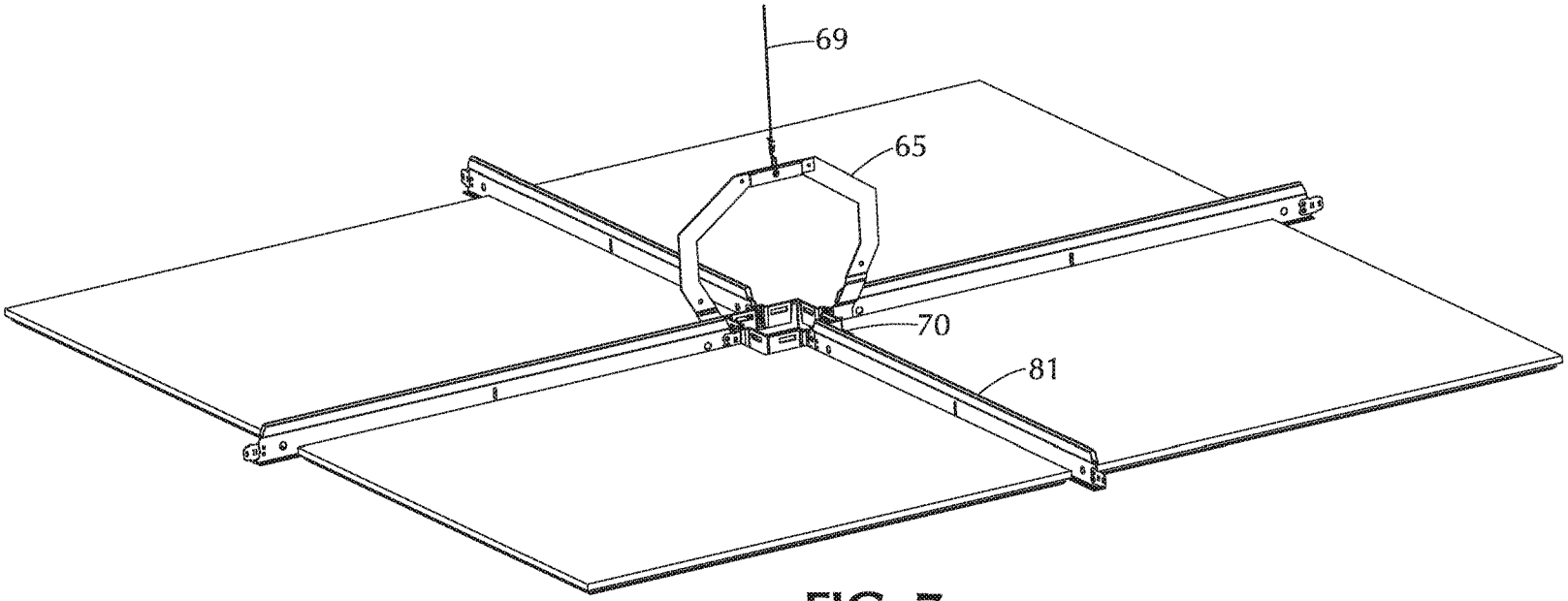
FIG. 7 is a perspective view of a suspended ceiling framework.
Figure 8:
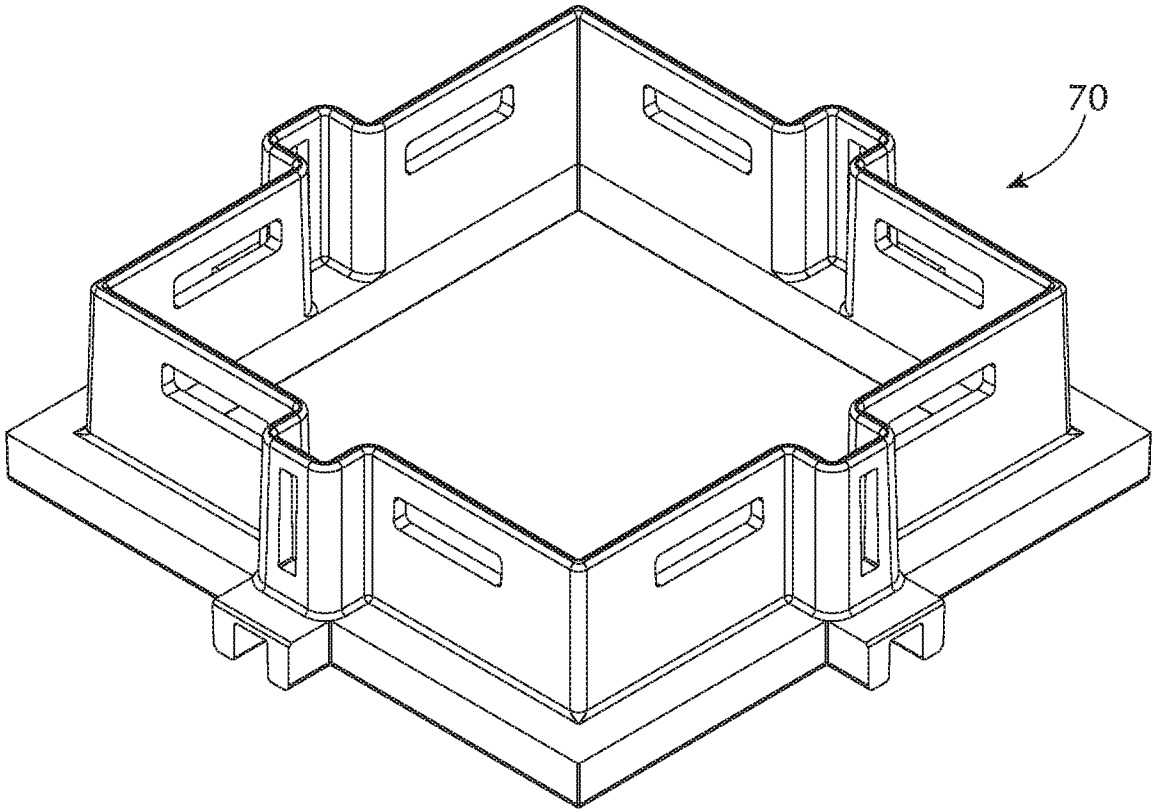
FIG. 8 is a perspective view of a hub of the suspended ceiling framework.
Figure 9:
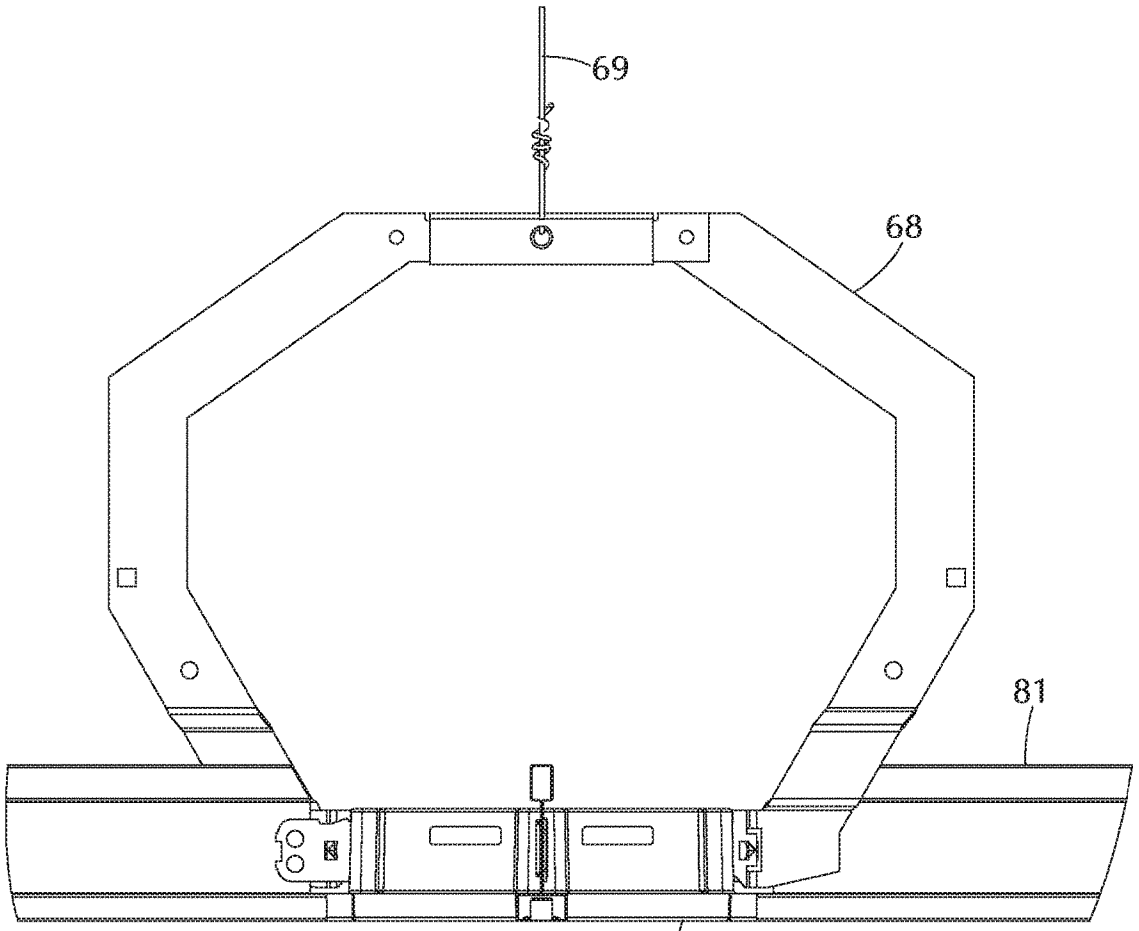
FIG. 9 is a side elevation view of the suspended ceiling framework.

In some embodiments such as illustrated in FIGS. 2-3, where the collar is rigidly connected to the arms (34) extending from housing, the side walls (43) extend past the back wall (42) to form arms (44) that connect to the housing. In this case, the top edges of the arms of the collar are provided with flanges (47). The flanges (47) are flush with the bottom of the arms (34) of the bottom wall (22) of the housing (20). As a result, the collar (40) is located below the plane of the bottom wall (22) of the housing. The collar (40) is secured to the bottom wall (22) of the housing with fasteners through holes provided in the flanges (47) of the collar's arms (44). It should be noted that the collar (40) may be joined with the housing with a variety of mechanical arrangements such as a flexible conduit, or may be integrally formed with the housing.

The collar (40) is mounted to the hub (70) from above such that a bottom portion of the collar rests on and is supported by a top portion of the hub, for example at least on two opposed sides of the peripheral vertical wall of the hub on opposed side of the opening defined by the hub. The collar can contact and rest on the hub (70) at the protrusions (71) of the hub at midpoints of the walls of the collar. Each midpoint of the walls of the collar can include a vertical cut out portion (47) on a bottom thereof which is aligned with a protrusion (71) of the hub and the walls of the collar (40), when resting on the protrusions (71) of the hub extend downwardly against and closely surrounds upper outside portions of the walls of the hub (70) at least on two opposed sides (and preferably all four sides) of the peripheral wall of the hub.

The collar (40) is removably secured to the hub without the use of a tool, with resilient retainer clips (45) which extend downwardly from the outer perimeter of the collar (40). In embodiments where the housing is rigidly connected with the collar (40), the retainer clips (45) are preferably disposed on opposing side walls (43) of the collar on either side of the centerline of the housing (20) or light fixture (10), rather than on the front and back walls (41, 42) of collar such that retainer clips are disposed on either side of the longitudinal axis of the rail to which the housing is mounted. This configuration maximizes the distance between the retainer clips (45) and the centerline or the rail which prevents the lighting system (10) from rotating about the rail, thus improving the balance and stability of the lighting system.

Each retainer clip (45) has a generally vertical base portion connected to the frame of the collar. Each retainer clip also has a first cam surface adjacent a free end of the clip which is angled downwardly and outwardly and is adapted to engage an outer edge of the hub during mounting to resiliently deflect the retainer clips outwardly, and has a second cam surface between the first cam surface and the base which is angled downwardly and inwardly and is adapted to engage the hub during dismounting to resiliently deflect the retainer clips outwardly. Corresponding slots are provided on each side of the perimeter of the hub (70) for cooperating with the clips (45). Although slots are only required on two opposing sides of the hub (70), they are provided on all four sides to allow flexibility in orienting the lighting system. Accordingly, the system can be installed on any of the four rails (81) connected to the hub (70).

The collar is mounted and dismounted toollessly to the hub (70) from above. To mount to the hub, the collar is pushed down until it contacts the top of the hub and the retainer clips (45) provided on the outer perimeter of the collar (40) snap into the matching slots of the hub (70). To dismount the collar, the collar can be pulled away (upwardly from) hub (70) causing the retainer clips (45) to be resiliently pried apart by the second cam surface. It should be noted that although retainer clips are discussed in the context of the present embodiment, other means of fastening the collar to the hub can be used. When the collar (40) is rigidly connected to the housing (20), the collar and housing are mounted to the framework at the same time, and where a yoke (65) is disposed over the hub (70), the collar of the light fixture can be inserted into the yoke prior to mounting the light fixture onto the framework.

Figure 10:
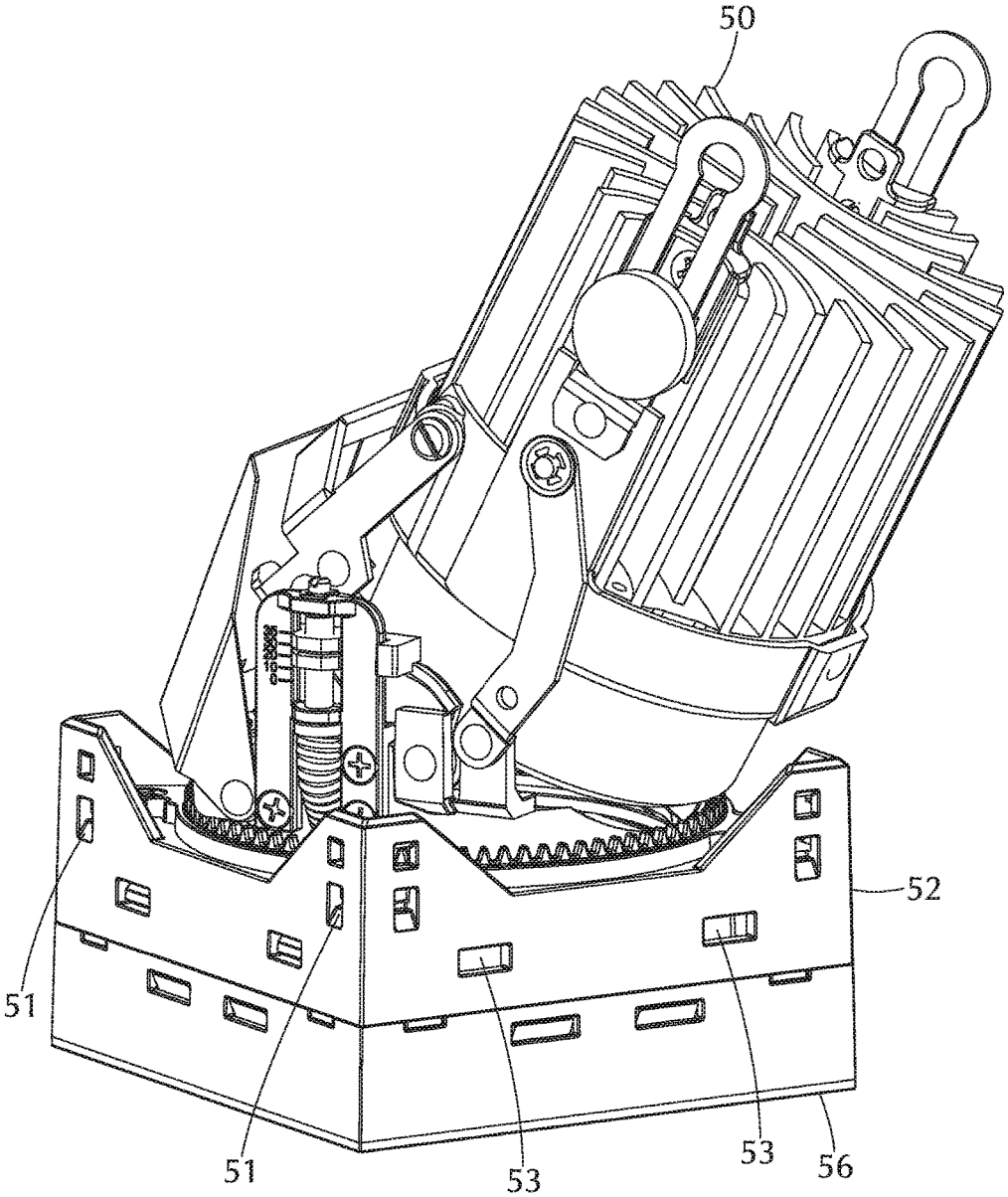
FIGS. 10-11 are perspective views of exemplary light units for the lighting system in accordance with embodiments of the present invention.
Figure 11:
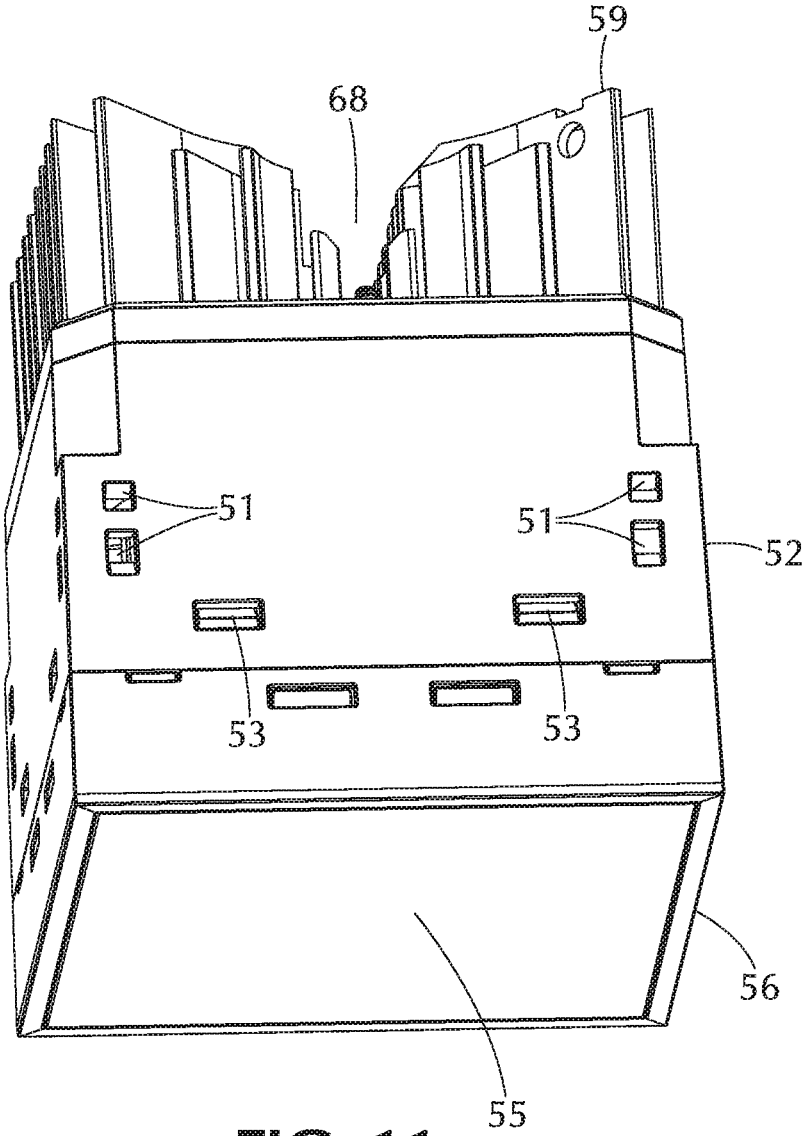
Figure 12:
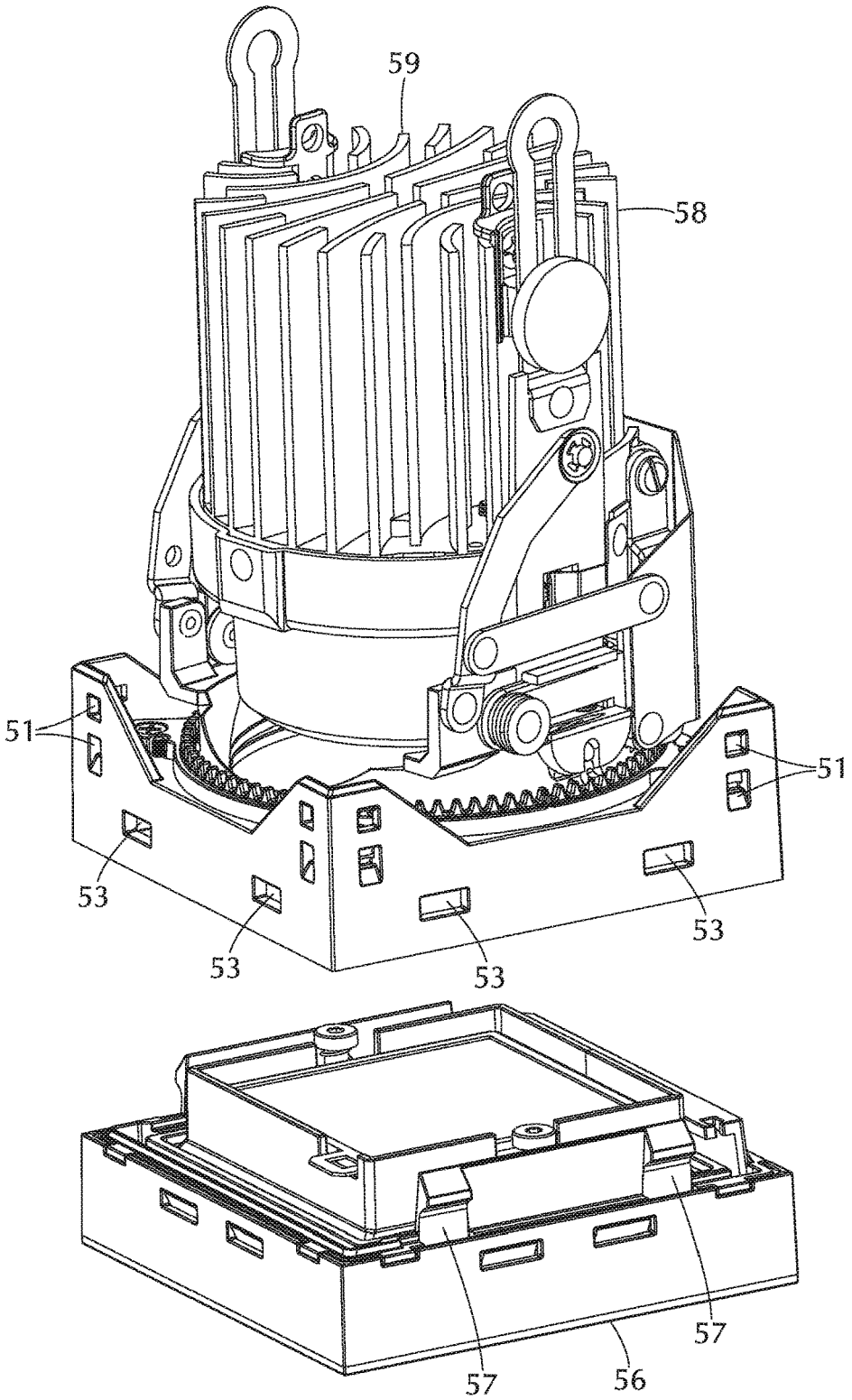
FIGS. 12-13 are exploded views of exemplary light units for the lighting system in accordance with embodiments of the present invention.
Figure 13:
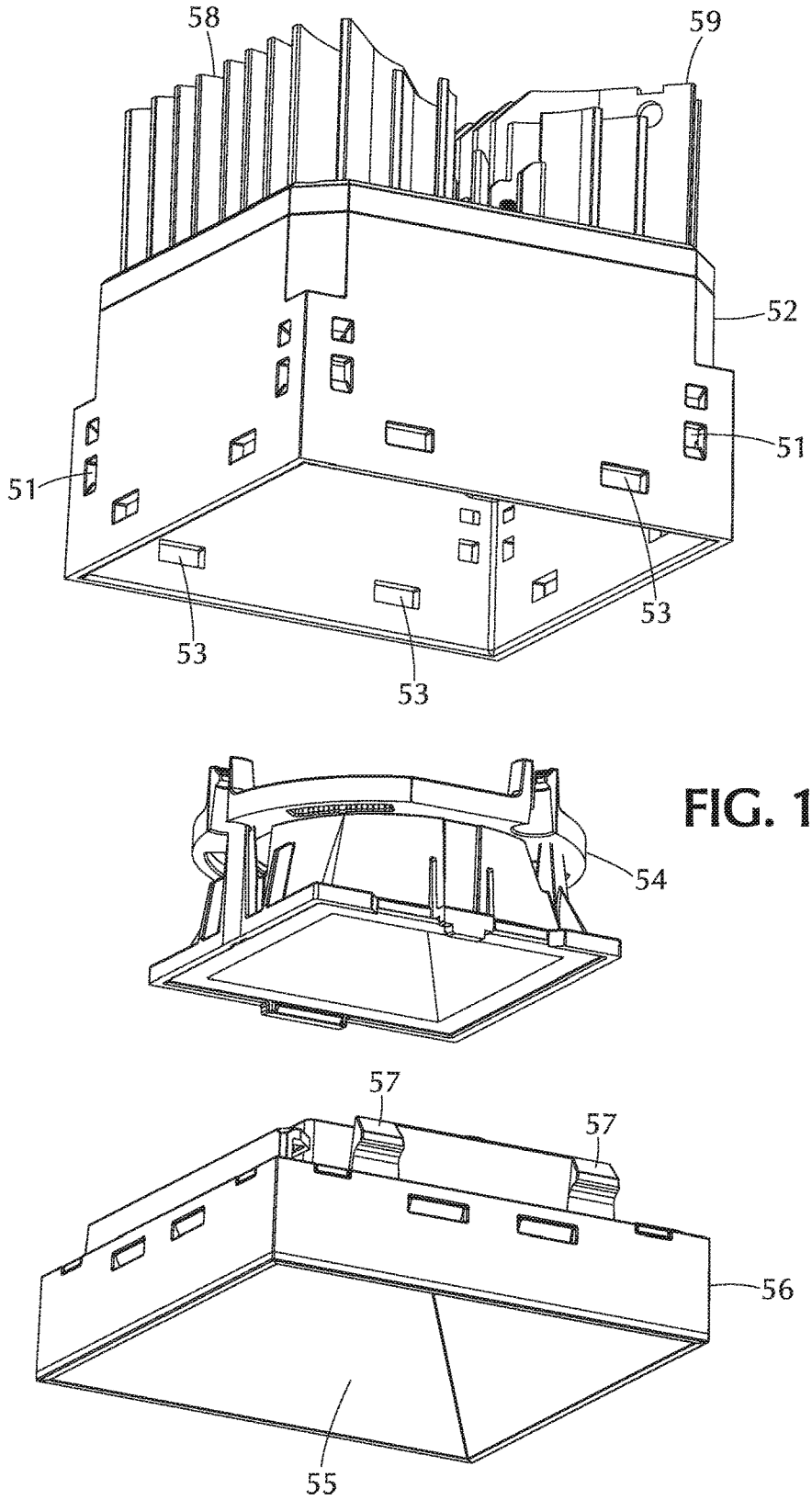
Figure 14:
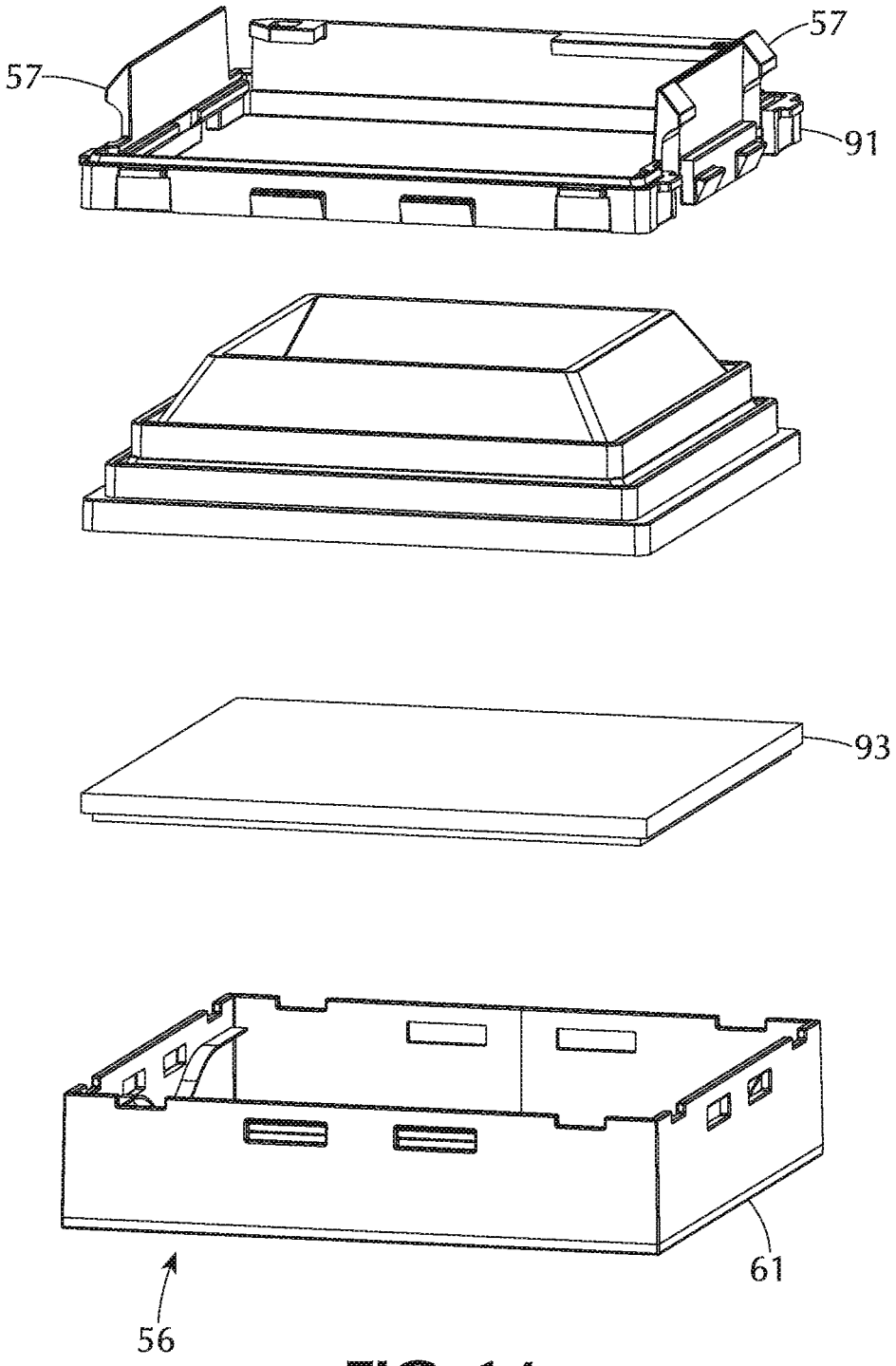
FIGS. 14-17 are exploded views of trim and lens elements of exemplary light units for the lighting system in accordance with embodiments of the present invention.

A light unit (50) is removably mounted to the collar (40) of the light fixture from below the collar (i.e., from the room, below the drop ceiling) without the use of a tool. Generally, the light unit (50) includes a chassis (52), lighting elements (54), a trim (56), and a heatsink (58). Exemplary light units suitable for the present invention are shown in FIGS. 10-13. The chassis (52) provides the structural support for the components of the light unit (50). In some embodiments, as shown in FIG. 11, the chassis (52) is an enclosure that holds components such as the lighting elements (54). In other embodiments, as shown in FIG. 10, the chassis (52) is a frame to which components of the light unit are mounted. The light unit (50) can be electrically connected to the housing (20) via wiring (not shown), directed through the hub (70) and collar (40), which can include releasable connectors (e.g., modular connectors).

The lighting elements (54) include an illumination device such as a lamp or an LED as well as related electronics and hardware such as a socket, light engine, optical system, filters, light diffusers, etc. (see FIGS. 12-17). The lighting unit (50) has an illumination aperture (55) at the bottom through which light from the lamp or LED is emitted. Typically, an ornamental trim (56) surrounds the light aperture (55) and serves to close the bottom of the light unit, thus securing the lamp and other lighting elements inside the chassis (52). The trim also serves as support for certain lighting elements of the light unit (50).

The trim (56) generally includes a trim casting (61), an injection molded frame (91) with mounting clips (57), a lens (93), and a lens retaining frame (94). The trim casting (61) is a frame shaped and sized as the horizontal cross-section of the light unit (50). The trim casting (61) can be made of cast metal. The trim casting (61) constitutes the base of the trim, and the injection molded frame (91), lens (93), and lens retaining frame (94) are mounted to the upper side of the trim casting (61) in various orders depending on the embodiment, as shown in FIGS. 14-17. The injection molded frame (91) is shaped and dimensioned to line the inner perimeter of the trim casting (61). Accordingly, in the embodiment shown in FIG. 15, the injection molded frame (91) is shaped as a square or a rectangle. On two opposing sides of the outer perimeter of the injection molded frame (91), a pair of horizontally spaced resilient clips (92) cooperates with mounting holes (92') provided on the side walls of the trim casting (61) to mount the frame (91) to the inner perimeter of the trim casting (61). The injection molded frame (91) is also provided with resilient retention clips (57) for mounting the trim (56) to the chassis (52) as will be further described below.

Figure 15:
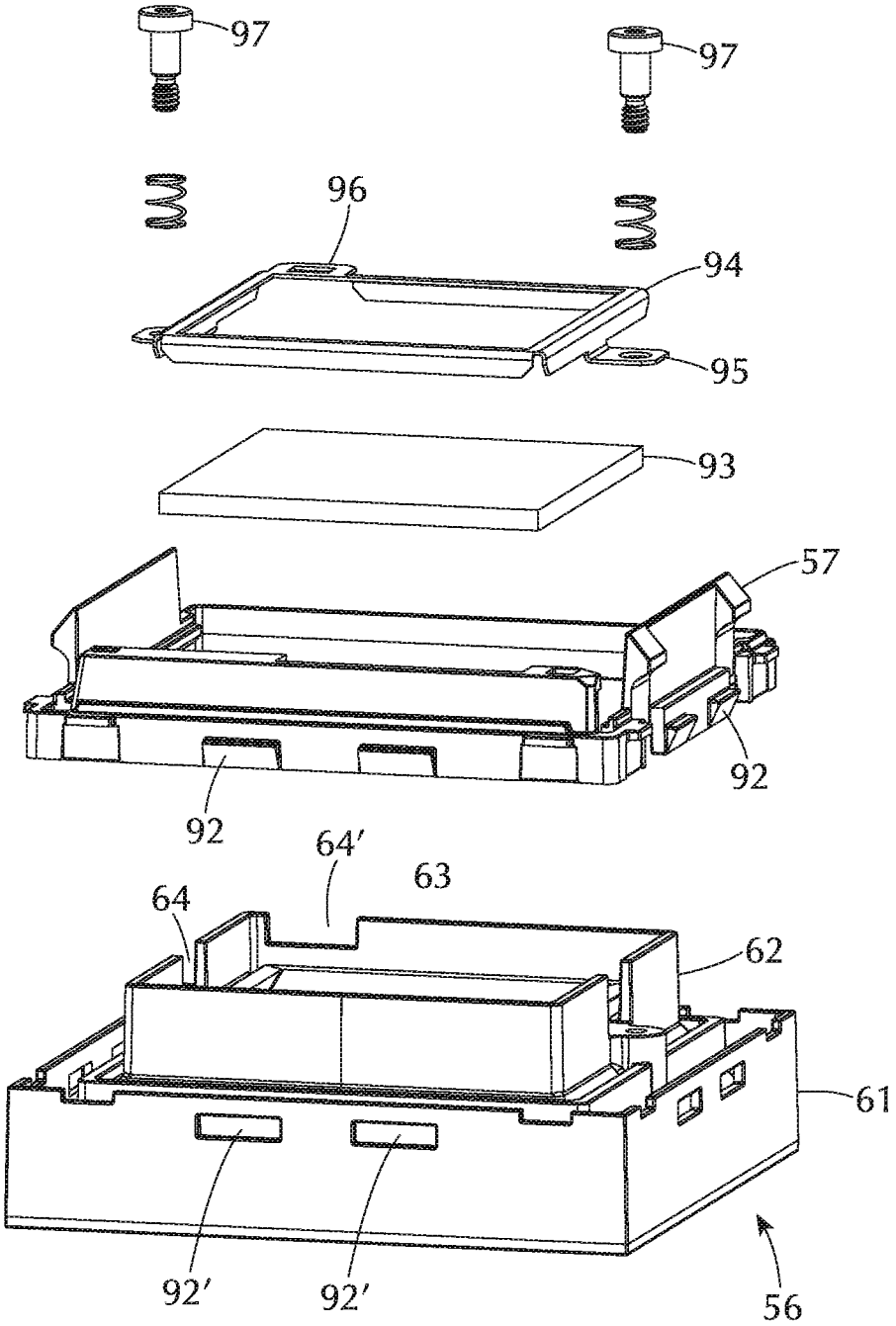

In some embodiments such as shown in FIG. 15, a peripheral flange (62) formed with vertical walls surrounds the aperture (55) on the upper surface of the trim casting (61). The peripheral flange (62) is shaped as the aperture (55) on the upper surface of the trim casting (61) and is spaced outwardly therefrom such that a ledge (63) exists between the aperture (55) and the peripheral flange (62). The ledge (63) serves as a support for the lens (93), which rests on top of it. The lens (93) is shaped as and dimensioned such that when it is installed over the aperture (55), its edges rest on the ledge (63) and its perimeter is surrounded by peripheral flange (62). The lens (93) can be made of glass, plastic, or any suitable material. The lens (93) is secured to the trim casting (61) using the lens retaining frame (94). The lens retaining frame (94) is a frame sized and shaped as the perimeter of the lens (93) such that it fits inside the peripheral flange (62) and closely surrounds the lens to secure the lens to the trim casting. Accordingly, the lens retaining frame (94) is shaped as a rectangle in FIG. 15. The retaining frame (94) is provided with at least one, and preferably at least two eyelets (95) that extend outward from the aperture near the bottom perimeter of the frame (94). Preferably, the eyelets (95) are aligned and extend from opposing sides of the frame (94) at a midpoint of the side, or an intermediate point substantially spaced from the end of the side; however, other locations and configurations are feasible. When the retaining frame (94) is placed over the lens (93) inside peripheral flange, the eyelets (95) protrude from the outer perimeter of the peripheral flange (62) through cut outs (64) provided for that purpose on the flange at the location of eyelets (95). Near each cut out (64) outside the peripheral flange (62), a tapped hole is provided on the upper surface of the trim casting (61) and the lens retaining frame (94) is movably secured to the casting with screws (97) directed through the eyelets (95) and threaded into the tapped holes. Preferably, spring-loaded shoulder screws (97) are used to secure the lens retaining frame (94) and lens to the trim casting (61). The screws (97) have a head portion at one end, a reduced, smooth (non-thread) neck portion below the head (e.g., about ½ inch in length), and a threaded end portion opposite the head. A spring is disposed around the neck portion between the head and an eyelet of the retaining frame to bias the lens retaining frame (94) and lens downward against the trim casting (61) while allowing for selective upward movement of the retaining frame and lens for adjustment or removal of the lens and for allowing use of lenses (93) of various thickness or lens stacking.

In some embodiments, the lens retaining frame (94) is also provided with a lifting tab (96) that protrudes laterally and outward from near the upper perimeter of the frame (94), preferably on a side other than the eyelets. Correspondingly, a cut out (64') is provided in the peripheral flange (62) at the level of the lifting tab (96) to accommodate the tab when the retaining frame is installed inside the flange. The lifting tab (96) serves as a handle for lifting the lens retaining frame (94) during replacement of the lens (93) or disassembly of the trim (56).

Figure 16:
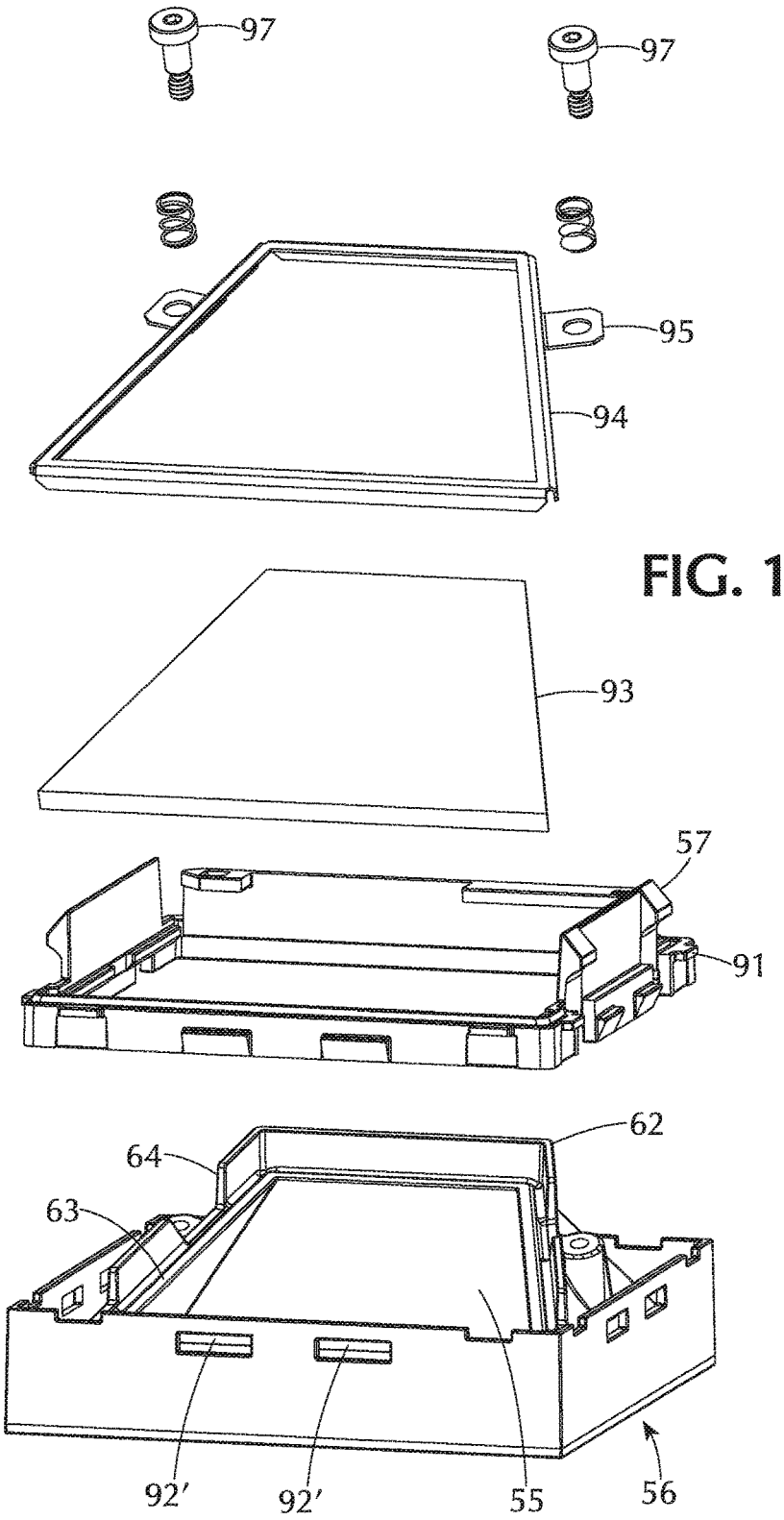
Figure 17:
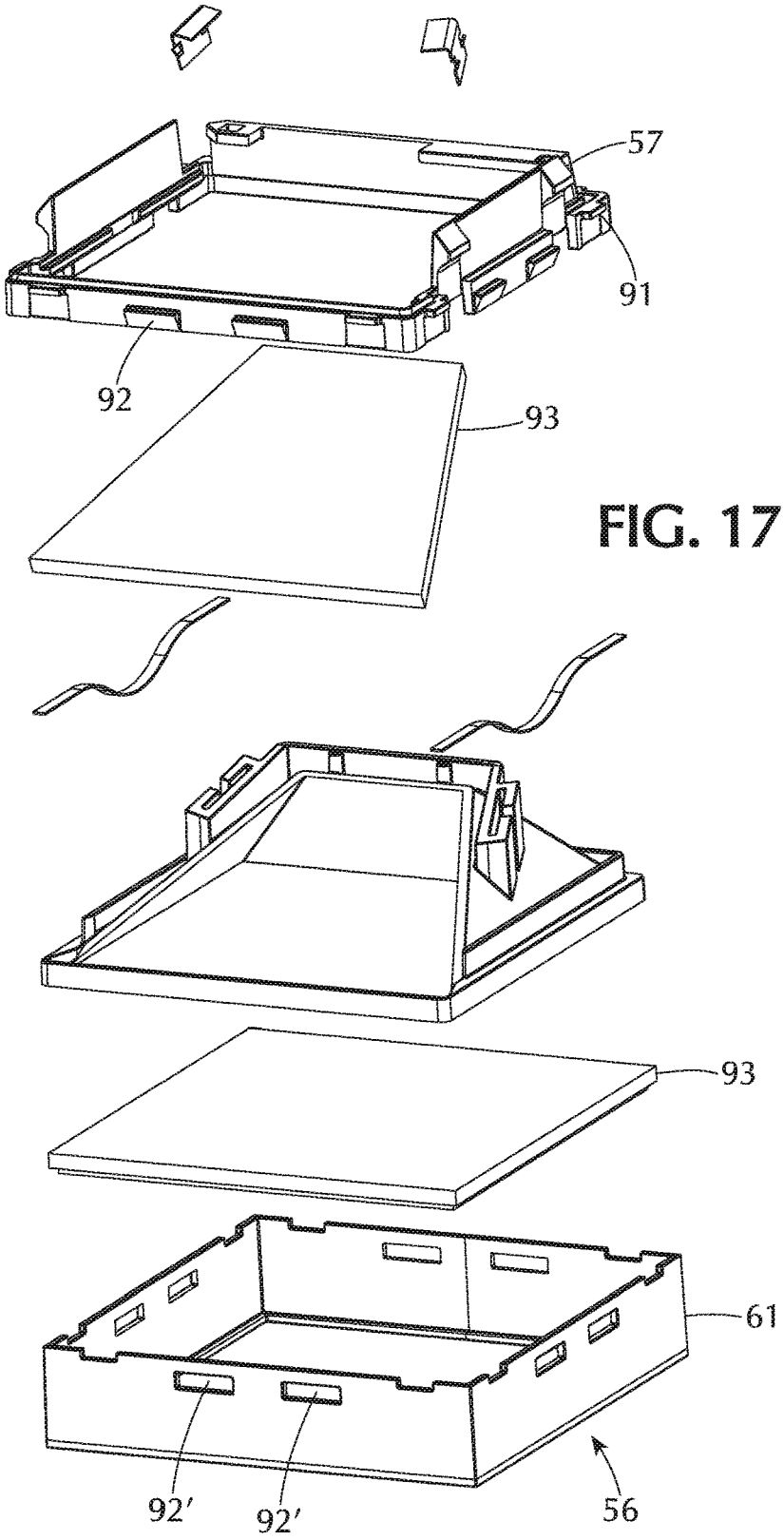

FIG. 16 shows a variation on the above-described trim assembly (56). In this embodiment, the peripheral flange (62), lens (93), and lens retaining frame (94) have a trapezoidal shape. Further, unlike the embodiment of FIG. 15 where the peripheral flange is horizontal, the peripheral flange (62) of FIG. 16 is slanted with respect to a horizontal plane. However, the other aspects of the trim assembly are the same or similar to the above trim assembly including the eyelets and spring-loaded screws. Thus the elements of the trim assembly (56) can have a variety of sizes, shapes and orientation while remaining in the scope of the invention.

The above-described assembly of the trim elements presents several advantages over traditional assemblies. The fastening of a lens retaining frame (94) over the lens (93) with spring-biased shoulder screws (97) provides a more secure assembly than lenses glued to the trim casting of more traditional arrangements. This arrangement is also more versatile because it allows in-field replacement of the lens (93). The combination of the peripheral flange (62) and shoulder screws (97) also permits the trim assembly (56) to accommodate lenses of various thickness or multiple lenses that can be stacked under the lens retaining frame without varying the screw thread depth. Further, the lens can be pushed upward from below at one of several locations (for example, at or adjacent any one of the four corners) to grasp the trim casting (61) in order to remove the trim from the light unit when the light unit is installed in the light fixture.

As discussed above, the trim (56) features resilient retention clips (57) for mounting to the chassis (52) of the light unit from below. Correspondingly, the chassis (52) is provided with mounting slots (53) into which the trim's retention clips (57) snap. In the embodiment shown, the trim's retention clips (57) are constructed with two pairs of injection molded tabs (57) extending from two opposing side walls of the trim (56) to cooperate with the corresponding slots (53) provided on the inner perimeter of the chassis (52). The trim (56) is thus mounted to the light unit (50) by pressing it against the bottom of the chassis (52) until the retention clips (57) snap into place. It should be noted that other means to attaching the trim (56) to the light unit (50) can be used.

A heatsink (58) is mounted to the light unit for dissipating heat generated by the electrical components therein. Typically, the heatsink is mounted on top of the light unit's chassis (52). The fins (59) of the heatsink (58) may be arranged to provide space (68) for a yoke (65), as will be described herein.

The light unit (50) can be of any shape provided that it will fit within the hub (70) and collar (40) from below, but preferably it has the same cross-sectional shape. Thus, it is understood that as an example, a light unit's (50) enclosure shaped as a cylinder or as box with a rectangular cross-section could mount to a circular collar or a rectangular collar, respectively. In the embodiment shown in FIG. 1, the light unit (50) and chassis (62) have a generally cubic shape, with a square horizontal cross-section matching the square collar. Likewise, in the embodiment shown in FIGS. 10 & 12, the light unit (50) has a chassis (52) with a square horizontal cross-section matching the square collar and hub.

The light unit (50) can be toollessly mounted to the collar (40) of the light fixture, from below (i.e., from within the room, below the suspended ceiling). The hub (70) and collar (40) are dimensioned so that the light unit (50) clears the interior perimeter of the hub and collar on each side by a maximum distance of a few millimeters.

Mounting slots (51) are provided on the sides of the light unit's chassis (52) for securing the light unit to the collar (40). The slots (51) cooperate with the corresponding mounting pins (46) located on the inner periphery of the collar. In the embodiments shown in FIGS. 10-11, two pairs of slots (51) are disposed on each side on the outer surface of the light unit's chassis (52). In each pair, the slots (51) are vertically aligned and closely spaced. The bottom interior surface of the lower slot can slope downward and outwardly to match with the similar slope on the corresponding mounting pins of the collar (40), as will be described below.

Correspondingly, the inner perimeter of the collar (40) is provided with two pairs of vertically-aligned resilient mounting pins (46) positioned on each of two opposed sides of the inner perimeter of the collar so as to match and align with the slots (51) on the sides of the light unit (50). The mounting pins (46) are spring-biased such that outward pressure causes the pins (46) to resilient recess toward or into the wall (41, 42) of the collar (40). Each pair of pins (46) is rigidly linked or joined such that the pair move together. At rest, the pins protrude from the interior walls (41, 42) of the collar (40) such that the distance between pins (46) on opposing walls (41, 42) is slightly less than the width of the chassis (52) of the light unit (50). The bottom edge of each lower pin slopes upward and inwardly, away from its wall (41, 42) of the collar (40) forming a cam surface which engages a side wall of the chassis of the light unit to deflect the pins outwardly during mounting of a light unit to the collar. As a result, when the light unit (50) is inserted heatsink first into the collar (40) from the bottom, the sides of the unit's chassis (52) exert pressure on the cam surfaces of the lower pins (46), causing the pins to deflect outwardly during insertion until they snap into the light unit's mounting slots (51) to secure the unit into place. To disengage the light unit (50) from the collar (40), the pins are pulled back outwardly from the light unit using tabs (48) connected to the pins (46) on the outer surface of the collar, allowing the light unit (50) to be pulled down and out of the collar without the use of a tool. In an embodiment, the tabs (48) are not accessible from below the drop ceiling or through the opening formed by the hub such that, once mounted, the light unit cannot be removed from below the light fixture, without first removing one or more ceiling tiles to gain access to the tabs (48).

The lighting system (10) may include a yoke assembly (65) for securing the hub (70) to the drop ceiling. The yoke (65) is an assembly in the shape of an inverted U shape that runs from a sidewall of the hub, up and over the light unit, and back down to opposite sidewall of the hub (see FIGS. 1-9). The yoke (65) may also be mounted to side rails (81) instead of the hub (70), such that each end of the inverted U is attached to a side rail. Thus, the yoke assembly (65) straddles the light unit (50) in the lateral direction. The yoke assembly (65) includes a substantially horizontal yoke center (66) positioned above the light unit (50) and two yoke arms (67) each joining an opposed end of the yoke center (66) to a side of the hub (70) or a rail (81) on either side of the light unit. The yoke assembly (65) can be fixed or adjustable to change its width and height. In some embodiments, the yoke (65) can be pivoted around the lateral axis between the end points of the yokes arms to facilitate the installation or removal of the light unit.

The yoke (65) can serve as an element of linkage between the drop ceiling and the structural ceiling or other support structure. In this configuration, the yoke center (66) is attached to a hanger rod (69) or hanger wire (69) from the structural ceiling and serves to suspend the drop ceiling (see FIG. 4). The yoke (65) can also reinforce the integrity of the installation by supplying an additional structural frame to the system. In some embodiments where the height of the light unit can interfere with the yoke, the heatsink (58) of the light unit is adapted to accommodate the yoke (65) as shown in FIGS. 1, 5-6 & 11, where space or gap (68) is provided between the fins (59) of the heatsink to receive and allow passage of the yoke center there through when the light unit is mounted to the collar.

The lighting system is designed to meet seismic code standards to enable to the light fixture to remain secured to the drop ceiling during certain seismic events. In particular, at least the clips (30) which connect the housing to the rails, the connection between the collar (40) and the hub (70), and the lighting unit (50) and the collar (40) are all designed to meet or exceed seismic code standards.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A lighting fixture for a suspended ceiling having a framework for supporting ceiling tiles, the framework including a grid of rails each having opposed horizontal flanges for supporting the ceiling tiles and a vertical portion extending upwardly from the horizontal flanges, and including a hub interconnecting a plurality of rails, where the hub forms an opening in the suspended ceiling, the lighting fixture comprising:

a light unit operable to be mounted in the opening in the suspended ceiling;

a housing for enclosing a lighting driver for the light unit, the housing being operable to toollesly mount to the vertical portion of a rail, from above, the rail being among the plurality of rails interconnected by the hub;

the housing having a mounting clip operable to engage opposing sides of the vertical portion of the rail;

the mounting clip being operable to resiliently expand laterally during mounting of the housing onto the rail;

the mounting clip including a cam surface operable to engage the rail to resiliently expand the mounting clip during mounting onto the rail;

the rail being operable to support ceiling tiles on both lateral sides of the rail, below the housing, with the housing mounted to the rail;

a light unit support rigidly connected to the housing, the light unit support being operable to toollessly mount to the hub, from above;

the hub having a vertical peripheral wall defining the opening in the suspended ceiling;

the light unit support having a vertical peripheral wall adapted to contact top portions of at least two opposed side walls of the peripheral wall of the hub; and the light unit being operable to removably and toollessly mount to the light unit support, through the hub, from below the suspended ceiling.

2. The lighting fixture of claim 1, wherein:

the light unit has a mounting slot on at least two opposed sides thereof;

the light unit support has a pin projecting inwardly from the peripheral wall thereof on at least two opposing sides, each pin being operable to engage an associated mounting slot of the light unit, to mount the light unit to the light unit support;

each pin is resiliently mounted to the light unit support and biased in an engaged position wherein the pin is engaged with an associated mounting slot, and is movable into a disengaged position wherein the pin is disengaged with the associated mounting slot;

each pin has a cam surface operable to contact a side of the light unit and to deflect the pin outwardly from the light unit during mounting of the light unit to the light unit support; and each pin is operable to prevent downward removal of the light unit from the light unit support in the engaged position, and is operable to allow downward removal of the light unit from the light unit support in the disengaged position.

3. The lighting fixture of claim 2, wherein:

the light unit has a pair of mounting slots on at least two opposed sides thereof;

the light unit support has a pair of pins projecting inwardly from the peripheral wall thereof on at least two opposing sides, each pair of pins being operable to engage an associated pair of mounting slots of the light unit, to mount the light unit to the light unit support;

each pair of pins is jointly resiliently mounted to the light unit support and biased in an engaged position wherein the pair of pins are engaged with an associated pair of mounting slots, and each pair of pins is movable to a disengaged position wherein the pair of pins is disengaged from the associated pair of mounting slots;

a lower pin of each pair of pins has a cam surface operable to contact a side of the light unit and to deflect the pair of pins outwardly from the light unit during mounting of the light unit to the light unit support; and each pair of pins is operable to prevent upward and downward removal of the light unit from the light unit support in the engaged position and to permit at least downward removal of the light unit from the light unit support in the disengaged position.

4. The lighting fixture of claim 1, wherein:

the vertical portion of the rail includes a relatively wide head and a relatively narrow web below the head;

the mounting clip has a locking portion adapted to be disposed below and engage a bottom of the head of the rail, when the housing is mounted on the rail; and the housing has a bias operable to bias the housing upwardly from the rail and to urge the locking portion against the bottom portion of the head of the rail.

5. The lighting fixture of claim 1, wherein:

at least two opposed side walls of the peripheral wall of the hub each have a slot;

at least two opposed sides of the peripheral wall of the light unit support have a resilient retainer clip operable to toollessly and removably engage an associated slot of the hub; and each retainer clip has a first cam operable to engage a top of the peripheral wall of the hub and to resiliently deflect the retainer clip outwardly from the peripheral wall of the hub, during mounting of the light unit support to the hub.

6. The lighting fixture of claim 5, wherein:

each retainer clip has a second cam operable to engage an edge of an associated slot of the peripheral wall of the hub and to resiliently deflect the retainer clip outwardly from the peripheral wall of the hub, during removal of the light unit support from the hub.

7. The lighting fixture of claim 1, wherein:

the light unit has lens and has a lens retaining frame disposed around a periphery of the lens; and the lens retaining frame being spring biased against the lens on opposed sides of the lens retaining frame.

8. A lighting fixture for a suspended ceiling having a framework for supporting ceiling tiles, the framework including a grid of rails each having opposed, horizontal flanges for supporting the ceiling tiles and a vertical portion extending upwardly from the horizontal flanges, and including a hub interconnecting a plurality of rails, where the hub forms an opening in the suspended ceiling, the lighting fixture comprising:

a light unit operable to mount in the opening in the suspended ceiling;

a housing for enclosing a lighting driver for the light unit, the housing being operable to toollessly mount to the vertical portion of a rail, from above, the rail being among the plurality of rails interconnected by the hub;

the housing having a mounting clip with a pair of tabs extending downwardly from a bottom of the housing, and the tabs being operable to engage opposing sides of the vertical portion of the rail;

the vertical portion of the rail including a relatively wide head and a relatively narrow web below the head;

at least one tab of the mounting clip having a locking portion adapted to be disposed below and engage a bottom of the head of the rail, when the housing is mounted on the rail; and the mounting clip being operable to be engaged with the rail, with the locking portion engaging the bottom of the head of the rail, with a downward movement of the housing onto the rail, from above.

9. The lighting fixture of claim 8, wherein:

the mounting clip is operable to resiliently expand laterally during mounting of the housing onto the rail to allow passage of the locking portion over the head of the rail, and to contract once the locking portion has passed the head of the rail; and at least one of the tabs of the mounting clip includes a cam surface operable to engage the head of the rail to resiliently expand the mounting clip during mounting onto the rail.

10. The light fixture of claim 9, wherein:

the housing has a bias operable to bias the housing upwardly from the rail and to urge the locking portion against the bottom portion of the head of the rail.

11. The lighting fixture of claim 10, wherein:

an upper portion of each tab is adapted to closely receive and abut the head of the rail, and a lower portion of each tab is adapted to abut and closely receive the web portion of the rail.

12. The lighting fixture of claim 11, wherein:

the rail is operable to support ceiling tiles on both lateral sides of the rail, below the housing, with the housing mounted to the rail.

13. A lighting fixture for a suspended ceiling having a framework for supporting ceiling tiles, the framework including a grid of rails and a hub interconnecting a plurality of rails, where the hub forms an opening in the suspended ceiling, the lighting fixture comprising:

the hub having a vertical peripheral wall defining the opening in the suspended ceiling;

at least two opposed sides of the peripheral wall of the hub each having a slot;

a light unit support operable to toollessly mount to the hub, from above;

the light unit support having a vertical peripheral wall adapted to closely surround the peripheral wall of the hub and to contact top portions of at least two opposed sides of the peripheral wall of the hub;

at least two opposed side of the peripheral wall of the light unit support having a resilient retainer clip operable to toollessly and removably engage an associated slot of the hub;

each retainer clip having a first cam operable to engage a top of the peripheral wall of the hub and to resiliently deflect the retainer clip outwardly from the peripheral wall of the hub, during mounting of the light unit support to the hub; and a light unit operable to mount to the light unit support.

14. The lighting fixture of claim 13, wherein:

each retainer clip has a second cam operable to engage an edge of an associated slot of the peripheral wall of the hub and to resiliently deflect the retainer clip outwardly from the peripheral wall of the hub, during removal of the light unit support from the hub.

15. A lighting fixture for a suspended ceiling having a framework for supporting ceiling tiles, the framework including a grid of rails and a hub interconnecting a plurality of rails, where the hub forms an opening in the suspended ceiling, the lighting fixture comprising:

the hub having a vertical peripheral wall defining the opening in the suspended ceiling;

a light unit support operable to mount to the hub;

the light unit support having a vertical peripheral wall adapted to closely surround the peripheral wall of the hub and to contact top portions of at least two opposed sides of the peripheral wall of the hub;

a light unit operable to toollessly mount to the light unit support through the hub, from below the suspended ceiling;

the light unit having a pair of mounting slots on at least two opposed sides thereof;

the light unit support having a pin projecting inwardly from the peripheral wall thereof on at least two opposing sides, each pin being operable to engage an associated mounting slot of the light unit, to mount the light unit to the light unit support;

each pin being resiliently mounted to the light unit support and biased in an engaged position wherein the pin is engaged with an associated mounting slot, and being movable into a disengaged position wherein the pin is disengaged with the associated mounting slot;

each pin having a cam surface operable to contact a side of the light unit and to deflect the pin outwardly from the light unit during mounting of the light unit to the light unit support; and each pin being operable to prevent downward removal of the light unit from the light unit support in the engaged position, and being operable to allow downward removal of the light unit from the light unit support in the disengaged position.

16. The lighting fixture of claim 15, wherein:

the light unit having a pair of mounting slots on at least two opposed sides thereof;

the light unit support having a pair of pins projecting inwardly from the peripheral wall thereof on at least two opposing sides, each pair of pins being operable to engage an associated pair of mounting slots of the light unit, to mount the light unit to the light unit support;

each pair of pins being jointly resiliently mounted to the light unit support and biased in an engaged position wherein the pair of pins are engaged with an associated pair of mounting slots, and each pair of pins being movable to a disengaged position wherein the pair of pins is disengaged from the associated pair of mounting slots;

a lower pin of each pair of pins having a cam surface operable to contact a side of the light unit and to deflect the pair of pins outwardly from the light unit during mounting of the light unit to the light unit support; and each pair of pins being operable to prevent upward and downward removal of the light unit from the light unit support in the engaged position and to permit at least downward removal of the light unit from the light unit support in the disengaged position.

17. A lighting fixture for a suspended ceiling having a framework for supporting ceiling tiles, the framework including a grid of rails each having opposed, horizontal flanges for supporting the ceiling tiles and a vertical portion extending upwardly from the horizontal flanges, and including a hub interconnecting a plurality of rails, where the hub forms an opening in the suspended ceiling, the lighting fixture comprising:

a light unit operable to mount in the opening in the suspended ceiling;

a housing for enclosing a lighting driver for the light unit, the housing being operable to toollessly mount to the vertical portion of a rail, from above, the rail being among the plurality of rails interconnected by the hub;

the housing having a mounting clip with a pair of tabs extending downwardly from a bottom of the housing, and the tabs being operable to engage opposing sides of the vertical portion of the rail;

the vertical portion of the rail including a relatively wide head and a relatively narrow web below the head;

at least one tab of the mounting clip having a locking portion adapted to be disposed below and engage a bottom of the head of the rail, when the housing is mounted on the rail;

the mounting clip being operable to resiliently expand laterally during mounting of the housing onto the rail to allow passage of the locking portion over the head of the rail, and to contract once the locking portion has passed the head of the rail; and at least one of the tabs of the mounting clip including a cam surface operable to engage the head of the rail to resiliently expand the mounting clip during mounting onto the rail.

18. The light fixture of claim 17, wherein:

the housing has a bias operable to bias the housing upwardly from the rail and to urge the locking portion against the bottom portion of the head of the rail.

19. The lighting fixture of claim 18, wherein:

an upper portion of each tab is adapted to closely receive and abut the head of the rail, and a lower portion of each tab is adapted to abut and closely receive the web portion of the rail.

20. The lighting fixture of claim 19, wherein:

the rail is operable to support ceiling tiles on both lateral sides of the rail, below the housing, with the housing mounted to the rail.

* * * * *